US012612559B2

(12) United States Patent
Radford et al.

(10) Patent No.: US 12,612,559 B2
(45) Date of Patent: Apr. 28, 2026

(54) PROCESSES AND SYSTEMS FOR REMOVING DEPOSITS FROM AN INTEGRATED PLASTIC PYROLYSIS VESSEL AND A STEAM CRACKING FURNACE

(71) Applicant: ExxonMobil Technology and Engineering Company, Baytown, TX (US)

(72) Inventors: Kara R. Radford, Houston, TX (US); David Spicer, Houston, TX (US); Saurabh S. Maduskar, Houston, TX (US); Theodore W. Walker, Chittenango, NY (US); Alison M. Miller, Houston, TX (US); Steven M. Slack, Humble, TX (US)

(73) Assignee: ExxonMobil Technology and Engineering Company, Baytown, TX (US)

( * ) Notice: Subject to any disclaimer, the term of this patent is extended or adjusted under 35 U.S.C. 154(b) by 175 days.

(21) Appl. No.: 18/405,762

(22) Filed: Jan. 5, 2024

(65) Prior Publication Data

US 2024/0247194 A1 Jul. 25, 2024

Related U.S. Application Data

(60) Provisional application No. 63/480,614, filed on Jan. 19, 2023.

(51) Int. Cl.
*C10G 9/16* (2006.01)
*C10G 1/00* (2006.01)
(Continued)

(52) U.S. Cl.
CPC ..... *C10G 9/16* (2013.01); *C10G 1/002* (2013.01); *C10G 1/10* (2013.01); *C10G 75/04* (2013.01)

(58) Field of Classification Search
CPC ..... A61K 31/7105; A61K 2239/31; A61K 2239/38; A61K 2239/49; A61K 2300/00;
(Continued)

(56) References Cited

U.S. PATENT DOCUMENTS 5,731,483 A * 3/1998 Stabel ..... B29B 13/022 208/130
7,578,929 B2 8/2009 Stell et al.
(Continued)

FOREIGN PATENT DOCUMENTS

WO WO 2021/216281 10/2021
WO WO 2021/216285 10/2021
(Continued)

OTHER PUBLICATIONS

Kusenberg et al. ("Towards high-quality petrochemical feedstocks from mixed plastic packaging waste via advanced recycling: The past, present and future", Fuel Processing Technology, Elsevier BV NL, vol. 238, (Sep. 6, 2022) (Year: 2022).*
(Continued)

*Primary Examiner* — Ellen M Mcavoy
*Assistant Examiner* — Chantel Graham
(74) *Attorney, Agent, or Firm* — WOMBLE BOND DICKINSON (US) LLP; Kevin Davis

(57) ABSTRACT

Processes for removing deposits from a pump-around loop or simply loop. The process can include isolating a first and a second end of the loop in fluid communication with a vessel to provide an isolated section. The isolated section can include a first conduit disposed within a convection section of a steam cracking furnace or a heat exchanger that
(Continued)

is external to the steam cracking furnace that can include char therein. The first end can be connected to an aqueous fluid/oxidant source. The second end can be connected to a second conduit disposed within the convection section. An aqueous fluid/oxidant mixture can be introduced into the first end that can be heated by flowing through the isolated section. The heated mixture can flow through the second conduit to produce a second heated mixture that can be introduced into a radiant section of the steam cracking furnace.

25 Claims, 2 Drawing Sheets

(51) Int. Cl.
*C10G 1/10* (2006.01)
*C10G 75/04* (2006.01)

(58) Field of Classification Search
CPC ..... A61K 31/713; A61K 35/76; A61K 40/13; A61K 40/24; A61K 40/42; A61K 40/46; A61K 48/0066; A61K 9/127; A61K 9/5068; A61K 9/5176; A61K 48/00; A61P 35/00; A61P 21/00; C12N 15/113; C12N 15/85; C12N 15/86; C12N 2310/141; C12N 2330/51; C12N 2510/00; C12N 5/0635; C12N 15/111; C12N 15/63; C12N 2750/14143; C12N 7/00; C12N 2750/14145; Y02A 50/30; F15B 9/16; C10B 53/07; C10G 1/002; C10G 1/10; C10G 75/04; C10G 9/002; C10G 9/16
See application file for complete search history.

(56) References Cited

U.S. PATENT DOCUMENTS

| | | | |
|---|---|---|---|
| 7,820,035 | B2 | 10/2010 | McCoy et al. |
| 12,065,616 | B2 | 8/2024 | Uppili et al. |
| 2009/0050530 | A1 | 2/2009 | Spicer et al. |
| 2020/0080009 | A1 | 3/2020 | Derks |
| 2022/0177788 | A1 | 6/2022 | Bitting et al. |
| 2022/0195309 | A1 | 6/2022 | Uppili et al. |
| 2022/0372375 | A1 | 11/2022 | Patel et al. |
| 2022/0389327 | A1 | 12/2022 | Reimers |
| 2023/0159834 | A1 | 5/2023 | Maduskar et al. |
| 2024/0110109 | A1 | 4/2024 | Laurent et al. |
| 2024/0191148 | A1 | 6/2024 | Patel et al. |
| 2024/0247193 | A1 | 7/2024 | Radford et al. |

FOREIGN PATENT DOCUMENTS

| | | |
|---|---|---|
| WO | WO 2022/020152 | 1/2022 |
| WO | WO 2024/155488 | 7/2024 |

OTHER PUBLICATIONS

Zimmermann et al: ("Ethylene" In: "Ullmann's Encyclopedia of Industrial Chemistry", pp. 1-50; Apr. 15, 2009) (Year: 2009).*
Zimmermann et al: ("Ethylene" In: "Ullmann's Encyclopedia of Industrial Chemistry", pp. 51-60; Apr. 15, 2009 (Year: 2009).*
Kusenberg Marvin et al: "Towards high-quality petrochemical feedstocks from mixed plastic packaging waste via advanced recycling: The past, present and future", Fuel Processing Technology, Elsevier BV, NL, vol. 238, Sep. 6, 2022 (Sep. 6, 2022), XP087221376, ISSN: 0378-3820, DOI: 10.1016/J.FUPROC.2022.107474 [retrieved on Sep. 6, 2022] figures 6,12 4.1. Fractionation via distillation 5.4. Plastic waste pyrolysis oils as drop-in feedstocks for industrial crackers abstract.
Heinz Zimmermann et al: "Ethylene" In: "Ullmann's Encyclopedia of Industrial Chemistry", Apr. 15, 2009 (Apr. 15, 2009), Wiley-VCH Verlag, Weinheim, XP055007506, ISBN: 978-3-52-730673-2 DOI: 10.1002/14356007.a10_045.pub3, Decoking on pp. 29-30 figures 4,10.

* cited by examiner

PROCESSES AND SYSTEMS FOR REMOVING DEPOSITS FROM AN INTEGRATED PLASTIC PYROLYSIS VESSEL AND A STEAM CRACKING FURNACE

CROSS-REFERENCE TO RELATED APPLICATIONS

This application claims priority to and the benefit of U.S. Provisional Application No. 63/480,614 having a filing date of Jan. 19, 2023, the disclosure of which is incorporated herein by reference in its entirety.

FIELD

This disclosure relates to processes for removing deposits, e.g., char, asphaltenes, and/or coke, from an integrated plastic pyrolysis vessel and a steam cracking furnace. More particularly, such embodiments relate to online and offline processes for removing char, asphaltenes, and/or coke deposits from an integrated plastic pyrolysis vessel and a steam cracking furnace.

BACKGROUND

Coke is an undesirable byproduct of steam cracking hydrocarbons that forms on internal surfaces of the steam cracking furnace, e.g., on the internal surface of radiant tubes disposed within a radiant section of the steam cracking furnace. Char is an undesirable byproduct of cracking plastic material under plastic pyrolysis conditions, which forms on internal surfaces of equipment, e.g., a plastic pyrolysis vessel.

The presence of char and/or coke on the internal surfaces reduces heat transfer to the stream passing therethrough, which reduces the amount of cracking of the plastic material and reduces the amount of cracking of the hydrocarbons. The presence of char and/or coke can also lead to undesirable changes in the composition of the internal surfaces, e.g., as a result of carburization, leading to deterioration of the equipment. Furthermore, the presence of char, asphaltenes, and/or coke can restrict the flow of materials through components of the system such as heat exchangers and transfer lines that can eventually cause sufficient plugging that the process needs to be shut down for maintenance.

There is a need, therefore, for improved processes for removing char and/or coke from an integrated plastic pyrolysis vessel and steam cracking furnace. This disclosure satisfies this and other needs.

SUMMARY

Processes and systems for removing deposits, e.g., char, asphaltenes, and/or coke, from an integrated plastic pyrolysis vessel and a steam cracking furnace are provided. In some embodiments, a process for removing deposits from a pump-around loop in a pyrolysis process, where the pump-around loop is in fluid communication with a vessel for cracking plastic, can include fluidly isolating a first end of the pump-around loop that is in fluid communication with the vessel and a second end of the pump-around loop that is in fluid communication with the vessel to provide a fluidly isolated section of the pump-around loop. The fluidly isolated section can include a first conduit disposed within a convection section of a steam cracking furnace or a heat exchanger that is external to the steam cracking furnace. The fluidly isolated section of the pump-around loop can include char deposited on an inner surface of the first conduit. The first end of the isolated section of the pump-around loop can be fluidly connected to an aqueous fluid and oxidant source. The second end of the isolated section of the pump-around loop can be fluidly connected with a second conduit disposed within the convection section of the steam cracking furnace. An aqueous fluid and an oxidant from the aqueous fluid and oxidant source can be introduced into the first end of the isolated section of the pump-around loop. The aqueous fluid and oxidant can be heated by flowing the aqueous fluid and oxidant through the fluidly isolated section of the pump-around loop to produce a first heated mixture that can include steam and at least one of char, any unreacted oxidant, and a combustion product produced by combusting at least a portion of the char. The first heated mixture can flow through the second conduit to produce a second heated mixture. The second heated mixture can be introduced into a radiant section of the steam cracking furnace.

In other embodiments, a process for removing deposits from a pump-around loop in a pyrolysis process, where the pump-around loop is in fluid communication with a vessel for cracking plastic, can include heating a hydrocarbon feed within a convection section of a steam cracking furnace and combining the hydrocarbon feed with an aqueous fluid to produce a first heated mixture that can include hydrocarbons and steam. The heating can be carried out before, during, and/or after the hydrocarbon feed is combined with the aqueous fluid. A first end of the pump-around loop that is in fluid communication with the vessel and a second end of the pump-around loop that is in fluid communication with the vessel can be fluidly isolated to provide a fluidly isolated section of the pump-around loop. The fluidly isolated section can include a first conduit disposed within the convection section of the steam cracking furnace or a heat exchanger that is external to the steam cracking furnace. The fluidly isolated section of the pump-around loop can include char deposited on an inner surface of the first conduit. The first end of the isolated section of the pump-around loop can be fluidly connected to an aqueous fluid source. The second end of the isolated section of the pump-around loop can be fluidly connected to a second conduit disposed within the convection section of the steam cracking furnace. An aqueous fluid from the aqueous fluid source can be introduced into the first end of the isolated section of the pump-around loop. The aqueous fluid can be heated by flowing the aqueous fluid through the fluidly isolated section of the pump-around loop to produce a second heated mixture comprising steam and char. The second heated mixture can be combined with the first heated mixture to produce a third mixture. The third mixture can flow through the second conduit to produce a heated third mixture. The heated third mixture can be introduced into a radiant section of the steam cracking furnace.

In other embodiments, a process for removing deposits from a pump-around loop in a pyrolysis process, where the pump-around loop is in fluid communication with a vessel for cracking plastic, can include fluidly isolating a first end of the pump-around loop that is in fluid communication with the vessel. The pump-around loop can include a conduit disposed within a convection section of a steam cracking furnace or a heat exchanger that is external to the steam cracking furnace and can have a second end in fluid communication with the vessel. The pump-around loop can include char deposited on an inner surface of the conduit disposed within the convection section or the heat exchanger. The first end of the pump-around loop can be fluidly connected to an aqueous fluid and/or oxidant source. An aqueous fluid and/or an oxidant can be introduced from the aqueous fluid and/or oxidant source into the first end of the pump-around loop. The aqueous fluid and/or oxidant can be heated by flowing the aqueous fluid and/or oxidant through the pump-around loop to produce a first heated mixture that can include steam, at least one of char and if the oxidant is present, any unreacted oxidant and a combustion product produced by combusting at least a portion of the char. The first heated mixture can be introduced into the plastic pyrolysis vessel. A vapor phase overhead and a solid-containing bottoms material can be obtained from the vessel. The vapor phase overhead can be introduced into a radiant section of the steam cracking furnace.

In other embodiments, a process for removing deposits from a pump-around loop in a pyrolysis process, where the pump-around loop is in fluid communication with a vessel for cracking plastic, can include heating a hydrocarbon feed within a convection section of a steam cracking furnace and combining the hydrocarbon feed with an aqueous fluid to produce a heated first mixture that can include hydrocarbons and steam. The heating can be carried out before, during, and/or after the hydrocarbon feed is combined with the aqueous fluid. A first end of the pump-around loop that is in fluid communication the vessel can be fluidly isolated. The pump-around loop can include a conduit disposed within the convection section of the steam cracking furnace or a heat exchanger that is external to the steam cracking furnace and can have a second end in fluid communication with the vessel. The pump-around loop can include char deposited on an inner surface of the conduit disposed within the convection section or the heat exchanger. The first end of the pump-around loop can be fluidly connected to an aqueous fluid source. An aqueous fluid from the aqueous fluid source can be introduced into the first end of the pump-around loop. The aqueous fluid can be heated by flowing the aqueous fluid through the pump-around loop to produce a heated second mixture that can include steam and at least a portion of the char. The heated second mixture can be introduced into the vessel. A vapor phase overhead and a solid-containing bottoms material can be obtained from the vessel. The vapor phase overhead can be combined with the heated first mixture to produce a third mixture. The third mixture can be introduced into a radiant section of the steam cracking furnace.

BRIEF DESCRIPTION OF THE DRAWINGS

The subject disclosure is further described in the detailed description that follows in reference to the drawings by way of non-limiting embodiments, in which like reference numerals represent similar parts throughout the several embodiments shown in the drawings.

DETAILED DESCRIPTION

Figure 1:
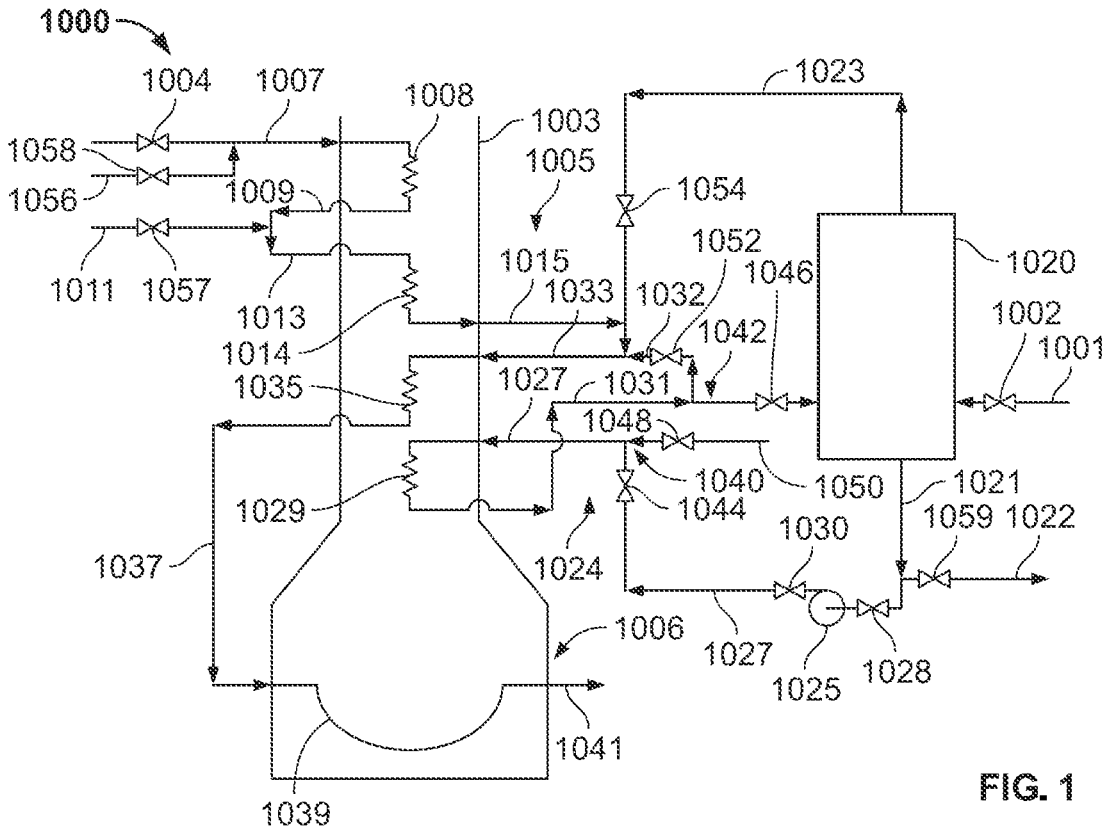
FIG. 1 depicts an illustrative process/system for removing char from a pump-around loop integrated with a plastic pyrolysis vessel and a stream cracking furnace and for removing coke deposited within a radiant section of the steam cracking furnace, in which the char removed from the pump-around loop is passed through the radiant section of the steam cracking furnace, according to one or more embodiments described.

Various specific embodiments, versions and examples of the invention will now be described, including preferred embodiments and definitions that are adopted herein for purposes of understanding the claimed invention. While the following detailed description gives specific preferred embodiments, those skilled in the art will appreciate that these embodiments are exemplary only, and that the invention may be practiced in other ways. For purposes of determining infringement, the scope of the invention will refer to any one or more of the appended claims, including their equivalents, and elements or limitations that are equivalent to those that are recited. Any reference to the "invention" may refer to one or more, but not necessarily all, of the inventions defined by the claims.

In this disclosure, a process is described as including at least one "step." It should be understood that each step is an action or operation that may be carried out once or multiple times in the process, in a continuous or discontinuous fashion. Unless specified to the contrary or the context clearly indicates otherwise, multiple steps in a process may be conducted sequentially in the order as they are listed, with or without overlapping with one or more other steps, or in any other order, as the case may be. In addition, one or more or even all steps may be conducted simultaneously with regard to the same or different batch of material. For example, in a continuous process, while a first step in a process is being conducted with respect to a raw material just fed into the beginning of the process, a second step may be carried out simultaneously with respect to an intermediate material resulting from treating the raw materials fed into the process at an earlier time in the first step. Preferably, the steps are conducted in the order described.

Unless otherwise indicated, all numbers indicating quantities in this disclosure are to be understood as being modified by the term "about" in all instances. It should also be understood that the precise numerical values used in the specification and claims constitute specific embodiments. Efforts have been made to ensure the accuracy of the data in the examples. However, it should be understood that any measured data inherently contains a certain level of error due to the limitation of the technique and/or equipment used for making the measurement.

Certain embodiments and features are described herein using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated.

As used herein, the indefinite article "a" or "an" shall mean "at least one" unless specified to the contrary or the context clearly indicates otherwise. Thus, embodiments using "a steam cracking furnace" include embodiments where one, two, or more steam cracking furnaces are used, unless specified to the contrary or the context clearly indicates that only one steam cracking furnace is used.

The term "hydrocarbon" as used herein means (i) any compound consisting of hydrogen and carbon atoms or (ii) any mixture of two or more such compounds in (i). The term "Cn hydrocarbon," where n is a positive integer, means (i) any hydrocarbon compound comprising carbon atom(s) in its molecule at the total number of n, or (ii) any mixture of two or more such hydrocarbon compounds in (i). Thus, a C2 hydrocarbon can be ethane, ethylene, acetylene, or mixtures of at least two of these compounds at any proportion. A "Cm to Cn hydrocarbon" or "Cm-Cn hydrocarbon," where m and n are positive integers and m<n, means any of Cm, Cm+1, Cm+2, . . . , Cn−1, Cn hydrocarbons, or any mixtures of two or more thereof. Thus, a "C2 to C3 hydrocarbon" or "C2-C3 hydrocarbon" can be any of ethane, ethylene, acetylene, propane, propene, propyne, propadiene, cyclopropane, and any mixtures of two or more thereof at any proportion between and among the components. A "saturated C2-C3 hydrocarbon" can be ethane, propane, cyclopropane, or any mixture thereof of two or more thereof at any proportion. A "Cn+ hydrocarbon" means (i) any hydrocarbon compound comprising carbon atom(s) in its molecule at the total number of at least n, or (ii) any mixture of two or more such hydrocarbon compounds in (i). A "Cn− hydrocarbon" means (i) any hydrocarbon compound comprising carbon atoms in its molecule at the total number of at most n, or (ii) any mixture of two or more such hydrocarbon compounds in (i). A "Cm hydrocarbon stream" means a hydrocarbon stream consisting essentially of Cm hydrocarbon(s). A "Cm-Cn hydrocarbon stream" means a hydrocarbon stream consisting essentially of Cm-Cn hydrocarbon(s).

The term "crude" means whole crude oil as it flows from a wellhead, a production field facility, a transportation facility, or other initial field processing facility, optionally including crude that has been processed by a step of desalting, treating, and/or other steps as may be necessary to render it acceptable for conventional distillation in a refinery. Crude is presumed to contain resid. The term "crude fraction" means a hydrocarbon fraction obtained via the fractionation of crude. Non-limiting examples of crudes can be or can include, but are not limited to, Tapis, Murban, Arab Light, Arab Medium, and/or Arab Heavy.

The term "resid" refers to a bottoms cut of a crude distillation process that contains non-volatile components. Resids are complex mixtures of heavy petroleum compounds otherwise known in the art as residuum or residual or pitch. Atmospheric resid is the bottoms product produced from atmospheric distillation of crude where a typical end-point of the heaviest distilled product is nominally 343° C., and is referred to as 343° C. resid. The term "nominally", as used herein, means that reasonable experts may disagree on the exact cut point for these terms, but by no more than +/−55.6° C. preferably no more than +/−27.8° C. Vacuum resid is the bottoms product from a distillation column operated under vacuum where the heaviest distilled product can be nominally 566° C., and is referred to as 566° C. resid.

The term "hydrocarbon feed" refers to a composition that includes one or more hydrocarbons. Illustrative hydrocarbon feeds can be or can include, but are not limited to, crude, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids and/or gases, natural gasoline, distillate, virgin naphtha, atmospheric pipestill bottoms, vacuum pipestill streams such as vacuum pipestill bottoms and wide boiling range vacuum pipestill naphtha to gas oil condensates, non-virgin hydrocarbons from refineries, vacuum gas oils, heavy gas oil, naphtha contaminated with crude, atmospheric residue, heavy residue, a C4/residue admixture, naphtha/residue admixture, hydrocarbon gases/residue admixture, hydrogen/residue admixtures, waxy residues, gas oil/residue admixture, relatively light alkanes, e.g., ethane, propane, butane, and/or pentane, recycle streams that can include ethane, propane, ethylene, propylene, butadiene, or a mixture thereof, one or more condensates, fractions thereof, or any mixture thereof.

The term "non-volatile components" as used herein refers to the fraction of a hydrocarbon-containing feed, e.g., a petroleum feed, having a nominal boiling point of at least 590° C., as measured by ASTM D6352-15 or D-2887-18. Non-volatile components include coke precursors, which are large, condensable molecules that condense in the vapor and then form coke during steam cracking of the hydrocarbon feed.

The term "coke" refers to the solid or semi-solid product that can be produced during the steam cracking of hydrocarbons that includes carbon and high carbon-content organic molecules, whether produced within the convection section, radiant section, transfer lines therebetween, or within transfer lines and other equipment, e.g., a transfer line heat exchanger, downstream of the radiant section.

The term "asphaltene" refers to a material obtainable from crude oil or other sources and having an initial boiling point above 650° C. and which is insoluble in a paraffinic solvent.

A "polymer" has two or more of the same or different repeating units/mer units or simply units. A "homopolymer" is a polymer having repeating units that are the same. A "copolymer" is a polymer having two or more repeating units that are different from each other. As such, the term "copolymer" includes terpolymers (a polymer having three units that are different from each other), tetrapolymers (a polymer having four units that are different from each other), and so on. The term "different" as used to refer to units indicates that the units differ from each other by at least one atom and/or are different isomerically.

In some embodiments, the polymer can be or can include, but is not limited to, a nitrogen-containing polymer, a chlorine-containing polymer, a bromine-containing polymer, a fluorine-containing polymer, an oxygen-containing polymer, a polyethylene polymer, a polypropylene polymer, a polystyrene polymer, a butadiene polymer, an isoprene polymer, an isobutylene polymer, or any mixture thereof. In some embodiments, the oxygen-containing polymer can be or can include a polyterephthalate polymer, an ethylene vinyl acetate polymer, a polycarbonate polymer, a polylactic acid polymer, an acrylate polymer, a polyoxymethylene polymer, a polyester polymer, a polyoxybenzylmethylenglycolanhydride polymer, a polyepoxide polymer, or any mixture thereof. In some embodiments, the nitrogen-containing polymer can be or can include one or more polyamide polymers, e.g., nylon; one or more polynitrile polymers, e.g., poly(acrylonitrile) and/or poly(methacrylonitrile); one or more aramids, one or more polyurethane polymers, or any mixture thereof. It is noted that polyamides, among other nitrogen-containing polymers, also contain oxygen as part of the polymer structure. In this disclosure, a polymer that includes both oxygen and nitrogen as part of the repeat unit for forming the polymer is defined as a nitrogen-containing polymer for purposes of characterizing the plastic feedstock. In some embodiments, the chlorine-containing polymers can be or can include, but are not limited to, polyvinyl chloride (PVC) and/or polyvinylidene chloride (PVDC). A polymer can be naturally occurring, modified naturally occurring, and/or synthetic.

The term "plastic material" refers to a composition that includes one or more polymers. Preferably, the plastic material comprises, consists essentially of, or consists of a synthetic polymer. Preferably, the plastic material comprises, consists essentially of, or consists of a used polymer. Preferably, the plastic material comprises, consists essentially of, or consists of one or more polymers derived from one or more olefin monomers (e.g., polyethylene, polypropylene, polyethylenepropylene, polystyrene, and the like).

It is noted that some types of plastic material can also include bio-derived components. For example, some types of plastic labels can include biogenic waste in the form of paper compounds. In some embodiments, 1 wt % to 25 wt % of the plastic material can correspond to bio-derived material. Such bio-derived material can also potentially contribute to the nitrogen content of a plastic material. The plastic material, in addition to the one or more polymers, can also include any additives, modifiers, packaging dyes, and/or other components typically added to a polymer during and/or after formulation. The plastic material can also further include any components typically found in polymer waste.

The plastic material alone or the plastic material mixed, blended, or otherwise combined with an optional carrier liquid is also referred to as a "heavy feed". Although the heavy feed may have a similar or identical composition as the hydrocarbon feed, preferably the heavy feed differs from the hydrocarbon feed. Although the hydrocarbon feed may contain a plastic material, e.g., the same or different plastic material contained in the heavy feed, preferably the hydrocarbon feed is substantially free, or completely free of a plastic material. Preferably, the hydrocarbon feed is derived from a petroleum source substantially free or completely free of a plastic material.

The optional "carrier liquid" disclosed herein that can be contacted with the plastic material and/or a liquid phase effluent at least partially derived from the plastic material can be or can include, but is not limited to, a wide range of petroleum or petrochemical products or streams (e.g., hydrocarbon products and/or intermediate streams produced from petroleum processing such as distillation, steam cracking, catalytic cracking, refining, and the like). For example, some suitable carrier liquids can correspond to, include, comprise, consist essentially of, or consist of:

(i) naphtha, kerosene, diesel, light or heavy cycle oils, catalytic slurry oil, gas-oils, white oils, derived from sources including but not limited to petroleum sources, e.g., from a refinery, a steam cracker, and/or a coker;
(ii) isoparaffins;
(iii) metallocene-derived hydrocarbons;
(iv) hydrocarbons produced from biologically derived raw materials;
(v) hydrocarbons derived from coal processing;
(vi) biologically derived raw materials for producing hydrocarbons;
(vii) ethylene-propylene copolymers; polybutenes;
(viii) polyalphaolefins ("PAOs"), including but not limited those described in or obtainable by using the processes described in U.S. Pat. Nos. 9,365,788, 9,409,834, 4,827,064, and 5,264,642;
(ix) alkylated benzenes;
(x) alkylated naphthalenes ("ANs");
(xi) esters such as adipate esters, phthalate esters, trimellitate esters, polyol esters (e.g., trimethylolpropane ("TMP") esters, pentaerythritol ("PE") esters, and blends thereof; and esters suitable for jet oils);
(xii) polyethers/polyalkylene glycols;
(xiii) thermally stable liquids, e.g., DOWTHERM® A available from Dow Chemical Company;
(xiv) naphthenic and/or aromatic solvents, such as toluene, benzene, methylnaphthalene, cyclohexane, methylcyclohexane, mineral oil, or any mixture thereof;
(xv) Group I, II, III, IV, or V lubricant basestocks, description of which can be found in EP2828367A1, which are incorporate herein by reference, including re-refined basestocks;
(xvi) lubricant formulations comprising any Group I, II, III, IV, or V lubricant basestock;
(xvii) crudes, condensates, or any mixture thereof;
(xviii) any formulation comprising one or more of the foregoing in one or more of groups (i) to (xvii); and
(xix) any mixture comprising two or more of the foregoing in one or more of groups (i) to (xvii), e.g., PAO/AN blends.

In some embodiments, the carrier liquid can be, can include, or can comprise a heat-soaked and/or hydrotreated hydrocarbon stream having an initial boiling point of at least 300° C. Boiling point distributions (the distribution at atmospheric pressure) can be determined, e.g., by conventional methods such as ASTM D7500-15(2019) or ASTM-D86-20b. A suitable heat-soaked hydrocarbon steam having an initial boiling point of at least 300° C. can be produced according to the processes disclosed in WO Publication No. WO2018/111577A1. A suitable hydrotreated hydrocarbon stream having an initial boiling point of at least 300° C. can be produced according to the processes disclosed in WO Publication No. WO2018/111577A1. A suitable heat-soaked and hydrotreated hydrocarbon stream having an initial boiling point of 300° C. can be produced according to the processes disclosed in WO Publication No. WO2018/111577A1. In some embodiments, when the heavy feed includes the plastic material combined with the carrier liquid, the heavy feed can be in the form of a solution, slurry, suspension, dispersion, or other fluid-type phase. As such, in some embodiments, the carrier liquid can act as a solvent.

The term "aqueous fluid" refers to a composition that includes water in the liquid phase, water in the vapor phase, or a mixture of water in the liquid phase and water in the vapor phase.

The terms "char" and "ash" interchangeably refer to the solid or solid/liquid mixture produced during the pyrolysis of an optionally contaminated plastic material and deposited on the inner surface of a conduit or vessel, which can include organic molecules having long carbon chains and/or high boiling points such as asphaltenes, coke, organometallic compounds, inorganic materials such as metals, metallic oxides, and salts, and mixtures thereof. Char and ash can be produced from the chemical reactions of the various components of a plastic material and/or introduced directly from the plastic feed material.

An "olefin" is a linear, branched, or cyclic compound of carbon and hydrogen having at least one double bond. The term "olefin product" as used herein means a product that includes an olefin, preferably a product consisting essentially of or consisting of an olefin. An olefin product in the meaning of this disclosure can be, e.g., an ethylene stream, a propylene stream, a butylene stream, an ethylene/propylene mixture stream, and the like.

The term "consisting essentially of" as used herein means the composition, feed, effluent, product, or other stream comprises a given component at a concentration of at least 60 wt %, preferably at least 70 wt %, more preferably at least 80 wt %, more preferably at least 90 wt %, still more preferably at least 95 wt %, based on the total weight of the composition, feed, effluent, product, or other stream in question.

The term "aromatic" as used herein is to be understood in accordance with its art-recognized scope which includes alkyl substituted and unsubstituted mono- and poly-nuclear compounds.

The term "rich" when used in phrases such as "X-rich" or "rich in X" means, with respect to an outgoing stream obtained from a device, that the stream comprises material X at a concentration higher than in the feed material fed to the same device from which the stream is derived.

The term "lean" when used in phrases such as "X-lean" or "lean in X" means, with respect to an outgoing stream obtained from a device, that the stream comprises material X at a concentration lower than in the feed material fed to the same device from which the stream is derived.

The terms "channel" and "line" are used interchangeably and mean any conduit configured or adapted for feeding, flowing, and/or discharging a vapor, a liquid, and/or a solid into the conduit, through the conduit, and/or out of the conduit, respectively. For example, a composition can be fed into the conduit, flow through the conduit, and can be discharged from the conduit to move the composition from a first location to a second location. Suitable conduits can be or can include, but are not limited to, pipes, hoses, ducts, tubes, and the like.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All concentrations herein are expressed on the basis of the total amount of the composition in question, unless specified otherwise. All ranges expressed herein should include both end points as two specific embodiments unless specified or indicated to the contrary.

Processes/Systems for Removing Char and Coke

A description of the processes/systems of this disclosure will now be made by referencing the non-limiting drawings showing various preferred embodiments.

FIG. 1

FIG. 1 depicts an illustrative process/system 1000 for removing char from a pump-around loop 1024 integrated with a plastic pyrolysis vessel 1020 and a stream cracking furnace 1003 and for removing coke deposited within a radiant section 1006 of the steam cracking furnace 1003, in which the char removed from the pump-around loop 1024 is passed through the radiant section 1006 of the steam cracking furnace 1003, according to one or more embodiments. The pump-around loop 1024 can include the vessel 1020, line 1021, one or more pumps 1025, line 1027, line 1029, and line 1031. During normal pyrolysis operation the process/system 1000 can be configured for steam cracking a mixture in line 1037 that includes a hydrocarbon feed/steam mixture from line 1015 and a vapor phase effluent from line 1023 derived from a heavy feed in line 1001. The heavy feed in line 1001 can include a plastic material. At least a portion of the plastic material in the heavy feed introduced via line 1001 into the vessel 1020 can be cracked in the vessel 1020 under plastic pyrolysis conditions to produce the vapor phase effluent and a liquid phase effluent that can be recovered or otherwise obtained via lines 1023 and 1021, respectively, from the vessel 1020. Heat energy in the flue gas in a convection section 1005 of the steam cracking furnace 1003 can be utilized to heat a plastic-containing stream or liquid phase effluent supplied in line 1027 via line 1029 to enable/maintain plastic pyrolysis conditions in the vessel 1020, thereby producing the vapor phase effluent in line 1023 exiting the top of vessel 1020, which contains among others, light hydrocarbons produced from plastic pyrolysis. As shown, line 1029 can be disposed within the convection section 1005 of the steam cracking furnace 1003. As such, in some embodiments, line 1029 can also be referred to as a first conduit disposed within the convection section 1005 of the steam cracking furnace 1003.

The vapor phase effluent in line 1023 can be in the gas phase or can primarily be in the gas phase with a minor amount in the liquid phase. When a minor amount of the vapor phase effluent in line 1023 is in the liquid phase, such minor amount can be up to about 5 wt %, 4 wt %, 3 wt %, 2 wt %, 1 wt %, 0.5 wt %, 0.1 wt %, or 0.01 wt %, based on the total weight of the vapor phase effluent. The vapor phase effluent in line 1023 can be or can include, but is not limited to, one or more hydrocarbons produced by pyrolyzing the plastic material within the vessel 1020. In some embodiments, the vapor phase effluent in line 1023 can also include one or more hydrocarbons produced by vaporizing and/or pyrolyzing a carrier liquid or other hydrocarbon-containing stream within the vessel 1020.

In some embodiments, at least a portion of the plastic material in the liquid phase effluent in line 1021 can be at least partially melted and/or solubilized. In some embodiments, at least a portion of the plastic material in the liquid phase effluent in line 1021 can be at least partially cracked such that at least a portion of the plastic material has been converted to one or more smaller chain polymers as compared to the plastic material in the heavy feed in line 1001. In some embodiments, a portion of the liquid phase effluent in line 1021 can be purged via line 1022 by opening valve 1059.

At least a portion of the liquid phase effluent in line 1021 can be pumped via the pump 1025 into line 1027 of the pump-around loop 1024 that includes line 1029 disposed within the convection section 1005 of the steam cracking furnace 1003 (or with a heat exchanger external to the convection section 1005). The liquid phase effluent in line 1027 can be heated within line 1029 to produce a heated fluid stream via line 1031 that can be recycled into the vessel 1020. Line 1029 can include a single pass or multiple passes through the convection section 1005 of the steam cracking furnace 1003 (or a heat exchanger external to the convection section 1005). The heated fluid stream in line 1031, upon exiting line 1029, can be at a temperature in a range, e.g., from 300° C., 325° C., 375° C., or 425° C. to 450° C., 500° C., or 550° C. In some embodiments, the heated fluid stream in line 1031 can be in the gas phase, the liquid phase, or a mixed gas/liquid phase. The heated fluid stream in line 1031, upon introduction into the vessel 1020, can be at a temperature in a range, e.g., from 300° C., 350° C., or 400° C. to 450° C., 500° C., 525° C., or 550° C. In some embodiments, the heated fluid stream in line 1031 can provide sufficient heat to the materials in vessel 1020 to achieve and maintain the plastic pyrolysis conditions, under which the plastic material and heavy hydrocarbons in the vessel 1020, including those in the heavy feed introduced via line 1001 and the residual plastic material returned via line 1031, undergo pyrolysis reactions. The pyrolysis reactions can involve the breakage of long carbon chains and/or carbon rings to form smaller, lighter organic compounds such as $C_1$-$C_4$ hydrocarbons, naphtha-boiling range compounds, gas oil boiling range compounds, and hydrogen. As the liquid phase effluent flows through the pump-around loop 1024 char can form present in the heavy feed in line 1001 can deposit on the inner surfaces of vessel 1020, line 1021, line 1027, line 1029, and/or line 1031.

A hydrocarbon feed in line 1007 can be heated within the convection section 1005 of the steam cracking furnace 1003. For example, the hydrocarbon feed in line 1007 can be heated in one or more internal heat exchangers 1008 and/or one or more internal heat exchangers 1014 disposed within the convection section 1005 of the steam cracking furnace 1003. The heat exchanger 1008 and/or 1014 can include a single pass or multiple passes through the convection section 1005 of the steam cracking furnace 1003. It should be understood that the convection section 1005 can be configured in any desired manner. In some embodiments, the convection section 1005 can also include one or more additional heat exchangers (not shown) that can be configured to heat boiler feed water to produce heated boiler feed water, steam, e.g., superheated steam, etc. There are many different configurations the convection section 1005 of the steam cracking furnace 1003 can be arranged in as will be appreciated by a person having ordinary skill in the art.

The hydrocarbon feed in line 1007 can be combined with an aqueous fluid (e.g., liquid water, steam, or mixture thereof) in line 1011. In some embodiments, the hydrocarbon feed in line 1007 can be heated before, during, and/or after the hydrocarbon feed in line 1007 is combined with the aqueous fluid in line 1011 to produce a heated mixture in line 1015 that includes hydrocarbons and steam. As shown in FIG. 1, the hydrocarbon feed in line 1007 can be initially heated within the internal heat exchanger 1008 to produce a heated hydrocarbon feed in line 1009, combined with the aqueous fluid in line 1011 to produce a mixture in line 1013, and the mixture in line 1013 can be heated within the internal heat exchanger 1014 to produce the heated mixture in line 1015. In other embodiments, however, a mixture that includes the hydrocarbon feed and an aqueous fluid can be introduced into the heat exchanger 1008. In still other embodiments, the aqueous fluid in line 1011 can be combined with the heated hydrocarbon feed in line 1015 to produce the heated mixture.

The heated mixture in line 1015 and the vapor phase effluent in line 1023 (or a portion thereof) can be combined to produce a combined mixture in line 1033. The combined mixture in line 1033 can be heated within one or more lines 1035 disposed within the convection section 1005 to produce the heated combined mixture via line 1037. Line 1035 can also be referred to as a second conduit disposed within the convection section 1005 of the steam cracking furnace 1003. Line 1035 can include a single pass or multiple passes through the convection section 1005 of the steam cracking furnace 1003. The heated combined mixture in line 1037 can be introduced into one or more radiant tubes or conduits 1039 disposed within the radiant section 1006 of the steam cracking furnace 1003 and steam cracked therein to produce a steam cracker effluent exiting the steam cracking furnace 1003 via line 1041. In certain embodiments, line 1035 can be located above line 1029 (as shown in FIG. 1) in the convection section 1005 to ensure that the fluid stream in line 1027 is heated in line 1029 to a desired high temperature to effect plastic pyrolysis in vessel 1020 under the desired pyrolysis conditions. In other embodiments, line 1035 can be located below line 1029 (not shown) or at the same elevation as line 1029 (not shown) in the convection section. The steam cracker effluent in line 1041 can include, among other products, hydrogen, $C_1$-$C_4$ hydrocarbons which can include one or more olefins, steam cracker naphtha, steam cracker gas oil, steam cracker quench oil, steam cracker tar, or any mixture thereof.

Figure 2:
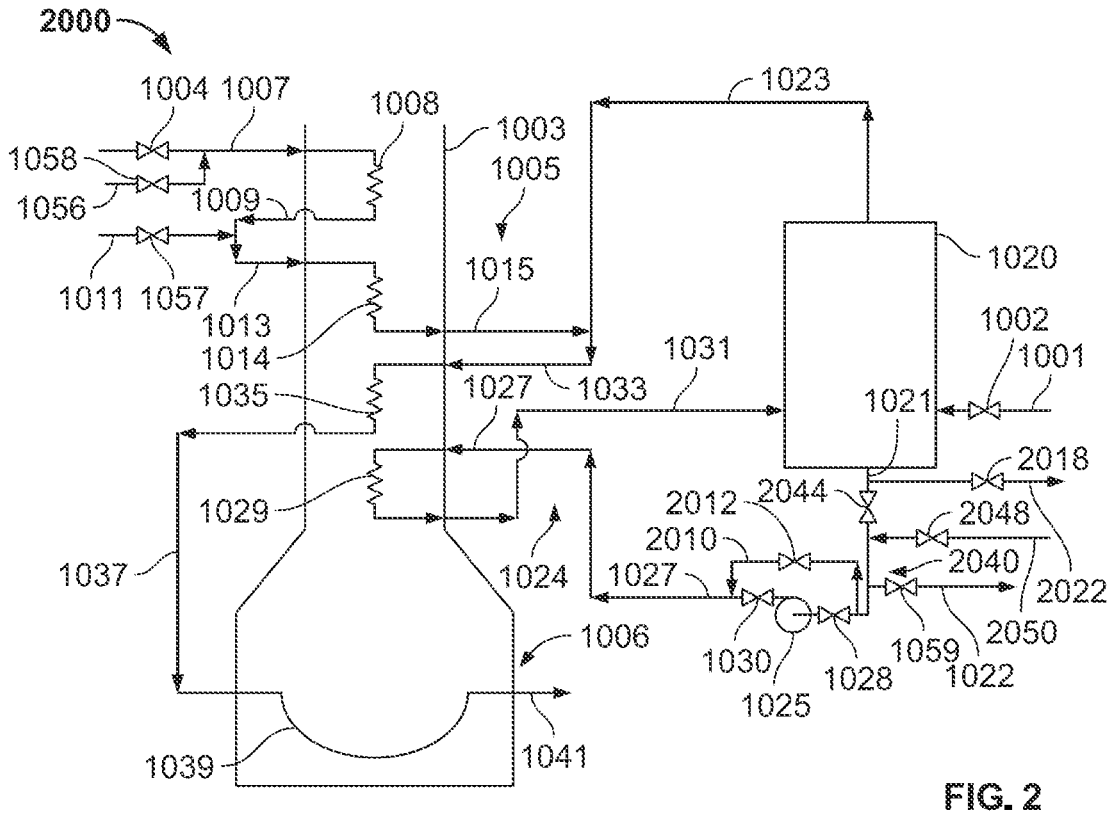
FIG. 2 depicts an illustrative process/system for removing char from a pump-around loop integrated with a plastic pyrolysis vessel and a steam cracking furnace and for removing coke deposited within a radiant section of the steam cracking furnace, in which the char removed from the pump-around loop is introduced into the plastic pyrolysis vessel, according to one or more embodiments described.
Figure 3:
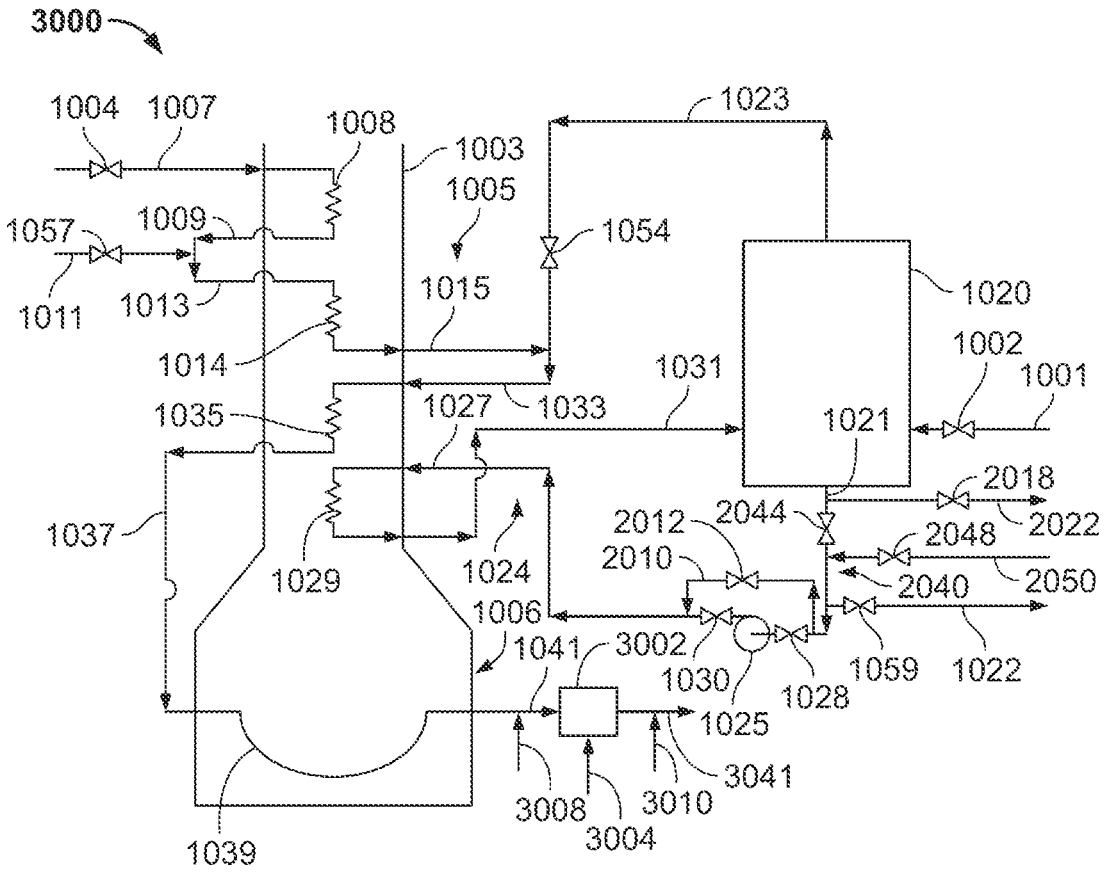
FIG. 3 depicts an illustrative process/system for removing char from a pump-around loop integrated with a plastic pyrolysis vessel and a steam cracking furnace while maintaining steam cracking of a hydrocarbon feed within a radiant section of the steam cracking furnace, according to one or more embodiments described.

As the combined mixture flows through line 1035 and/or as the heated combined mixture flows through line 1037 and/or the radiant tube(s) 1039, coke can form and deposit on the internal surfaces thereof. When an undesirable amount of char has deposited on the inner surfaces of the pump-around loop 1024, a process for removing char can be desirably carried out to remove at least a portion of the char from at least a part of the pump-around loop 1024, especially parts thereof subjected to high temperature and prone to char deposition, e.g., line 1029 and line 1031. When an undesirable amount of coke, asphaltenes, and/or char has deposited on the inner surfaces of line 1035, line 1037, the radiant tube(s) 1039, line 1041, and/or optional downstream conduits, a process for removing coke, asphaltenes, and/or char can be desirably carried out to remove at least a portion of the coke, asphaltenes, and/or char. In certain embodiments, the process for removing char from the pump-around loop 1204 and/or the process for removing coke, asphaltenes, and/or char from the inner surfaces of line 1035, line 1037, the radiant tube(s) 1039, line 1041, and/or optional downstream conduits may be carried out separately while the part of the pump-around loop 1024 subjected to char removal is isolated from the radiant tubes 1039 in the steam cracking furnace 1003. In other embodiments, which can be preferred, the process for removing char and the process for removing coke, asphaltenes, and/or char may be integrated as illustrated in FIGS. 1-3 and described below. In some embodiments, the process for removing char and the process for removing coke, asphaltenes, and/or char can be carried out in an "offline" mode that includes stopping introduction of the heavy feed in line 1001 into the vessel 1020 and stopping introduction of the hydrocarbon feed in line 1007, such that steam cracking of hydrocarbons is stopped in the radiant tubes 1039 of the steam cracking furnace 1003. In other embodiments, which can be preferred, the process for removing char can be carried out in an "online" mode that includes stopping introduction of the heavy feed in line 1001 into the vessel 1020, but continuing introduction of the hydrocarbon feed via line 1007, such that steam cracking of hydrocarbons continues in the radiant tubes 1039.

Offline Mode

When the offline mode decharring/decoking operation is desired to be carried out, introduction of the heavy feed in line 1001 and introduction of the hydrocarbon feed in line 1007 can be stopped. For example, valves 1002 and 1004 can be closed to stop introduction of the heavy feed in line 1001 and the hydrocarbon feed in line 1007, respectively. The overhead line 1023 can also be isolated from line 1033 by closing valve 1054. In some embodiments, the pump 1025 can also be at least partially fluidly isolated from the pump-around loop 1024 by closing valves 1028 and/or 1030.

The offline mode can also include fluidly isolating a first end 1040 of the pump-around loop 1024 that is in fluid communication with the vessel 1020 and a second end 1042 of the pump-around loop 1024 that is in fluid communication with the vessel 1020 to provide a fluidly isolated section of the pump-around loop 1024. For example, valves 1044 and 1046 can be closed to fluidly isolate the first end 1040 and the second end 1042, respectively, from the vessel 1020. The first end 1040 of the isolated section of the pump-around loop 1024 can be fluidly connected to an aqueous fluid and/or oxidant source. For example, a valve 1048 can be opened and an aqueous fluid and/or an oxidant (e.g., oxygen, such as oxygen in air) in line 1050 can be introduced into the first end 1040 of the isolated section of the pump-around loop 1024. The fluid in line 1050 preferably comprises steam and molecular oxygen as an oxidant. The fluid in line 1050 can be, e.g., steam, air, a steam/air mixture, a mixture of oxygen and an inert gas, a mixture of air and an inert gas, a mixture of steam, air, and an inert gas, and the like. Preferably, the fluid in line 1050 is a steam/air mixture. The second end 1042 of the isolated section of the pump-around loop 1024 can be fluidly connected to line 1033. For example, a valve 1052 can be opened and the aqueous fluid and/or oxidant introduced to the first end 1040 of the pump-around loop 1024 can flow therethrough and into line 1033 via line 1032. It should be understood that the first end 1040 of the pump-around loop 1024 and valve 1044 can be located at any desired position along the pump-around loop 1024 from between the vessel 1020 and introduction into line 1029. If the first end 1040 and the valve 1044 are located between the pump 1025 and the vessel 1020, a bypass line can be used to so that the pump 1025 can be bypassed, as described below with reference to FIGS. 2 and 3.

As the aqueous fluid and/or oxidant introduced via line 1050 into the pump-around loop 1024 flows therethrough, the aqueous fluid and/or oxidant can be heated within line 1029 to produce a heated or first heated mixture that can be recovered via line 1031. The first heated mixture in line 1031, upon exiting the convection section 1005, can be at a temperature in a range, e.g., from 300° C., 325° C., 350° C., 375° C., or 425° C. to 450° C., 500° C., or 550° C. The aqueous fluid and/or oxidant can remove at least a portion of the char deposited within the pump-around loop 1024 via spalling and/or other physical mechanism(s). When the oxidant is present at least a portion of the char can be combusted to produce a combustion product. As such, the first heated mixture introduced via line 1032 from the pump-around loop 1024 into line 1033 can include steam, if the oxidant is present, any unreacted oxidant, and at least one of (i) at least a portion of any char and, if the oxidant is present, (ii) the combustion products.

The first heated mixture in line 1033 can flow through line 1035 to produce a second heated mixture in line 1037 that can be introduced into the radiant tube(s) 1039 disposed within the radiant section 1006 of the seam cracking furnace 1003. The second heated mixture in line 1037 can be at a temperature in a range, e.g., from 300° C., 325° C., 350° C., 375° C., or 425° C. to 450° C., 500° C., or 550° C. The steam introduced via line 1011 can be continued or can be stopped by closing valve 1057. As such, in some embodiments, the first heated mixture in line 1033 can include only the contents from line 1032 or can include a combined heated mixture of the contents in line 1032 and steam from line 1015.

In some embodiments, the offline mode can also include introducing an oxidant (e.g., oxygen, such as oxygen in air) via line 1056, e.g., by opening valve 1058, and introduction of the aqueous fluid via line 1011 can be continued such that a heated oxidant and steam mixture can be provided in line 1015 that can be combined with the first heated mixture from the pump-around loop 1024 to produce a combined heated mixture in line 1033. It should be understood that the oxidant and steam can be combined at any point in the convection section 1005 ahead of the radiant section 1006. In other embodiments, the offline mode can include introducing an oxidant via line 1056, e.g., by opening valve 1058, and introduction of the aqueous fluid via line 1011 can be stopped by closing valve 1057 such that a heated oxidant can be provided in line 1015 that can be combined with the first heated mixture from the pump-around loop 1024 to produce the combined heated mixture in line 1033. The fluid in line 1056 preferably comprises molecular oxygen as an oxidant. The fluid in line 1056 can be, e.g., steam, air, a steam/air mixture, a mixture of oxygen and an inert gas, a mixture of air and an inert gas, a mixture of steam, air, and an inert gas, and the like. Preferably, the fluid in line 1056 is air. The steam, heated oxidant, or mixture thereof in line 1015, upon exiting the convection section 1005, can be at a temperature in a range, e.g., from 300° C., 325° C., 350° C., 375° C., or 425° C. to 450° C., 500° C., 550° C., 600° C., 650° C., 700° C., 725° C., or 750° C. The combined heated mixture in line 1033 can be heated in the heat exchanger or second conduit 1035 disposed within the convection section 1005 of the steam cracking furnace 1003 to produce the second heated mixture in line 1037.

As the first heated mixture or the combined heated mixture flows through line 1035 and as the second heated mixture flows through line 1037, the radiant tube(s) 1039, line 1041 and optional downstream conduit(s), at least a portion of any coke, asphaltenes, and/or char deposited therein can be removed via spalling and/or other physical mechanism(s). When the oxidant is present in the first heated mixture or the combined heated mixture in line 1033, at least a portion of any coke, asphaltenes, and/or char deposited within line 1035, line 1037, the radiant tube(s) 1039, line 1041, and optional downstream conduit(s) can be combusted to produce a combustion product that can be further treated by, e.g., by further combustion, separation, other processes, or any combination thereof. The combustion product can be produced by combusting at least a portion of any coke, any asphaltenes, and/or any char present in the first heated mixture or the combined heated mixture and/or at least a portion of any coke, asphaltenes, and/or char disposed on the inner surface of the heat exchanger or second conduit 1035, line 1037, and/or the radiant tube(s) 1039.

The offline mode can also include purging at least a portion of any liquid phase effluent present in the vessel 1020. For example, with valve 1028 closed to isolate the pump 1025 from the vessel 1020, at least a portion of any liquid phase effluent present within the vessel 1020 can be removed via lines 1021 and 1022 by opening valve 1059 while the section of the pump-around loop 1024 is fluidly isolated from the vessel 1020. In some embodiments, the liquid phase effluent removed via lines 1021 and 1022 can include, in addition to melted and/or solubilized plastic and, optionally, other hydrocarbons, and/or char. As such, char can also be removed from the system 1000 via lines 1021 and 1022 during the offline mode.

Once the offline mode has been carried out for a sufficient duration, introduction of the aqueous fluid and/or oxidant via line 1050 into the pump-around loop 1024 and introduction of the oxidant via line 1056, if used, into line 1007 can be stopped, e.g., by closing valves 1048 and 1058, respectively. The pump-around loop 1024 can be fluidly reconnected to the vessel 1020, e.g., by opening valves 1028, 1030, 1044, and 1046 and closing valves 1052 and 1059. Introduction of the heavy feed via line 1001, the hydrocarbon feed via line 1007, and, if stopped, the aqueous fluid via line 1011, can be restarted, e.g., by opening valves 1002, 1004, and 1057, respectively. The overhead line 1023 can be fluidly reconnected to line 1033 by opening valve 1054.

Online Mode

When the online decharring/decoking operation is desired to be carried out, introduction of the heavy feed in line 1001 can be stopped, but the introduction of the hydrocarbon feed via line 1007 can continue. For example, valve 1002 can be closed to stop introduction of the heavy feed in line 1001 and valves 1004 and 1057 can remain open to allow continued introduction of the hydrocarbon feed and the aqueous fluid, respectively. The hydrocarbon feed introduced via line 1007 can be heated within the convection section 1005 of the steam cracking furnace and combined with the aqueous fluid in line 1011 to produce a first heated mixture in line 1015. Heating the hydrocarbon feed can be carried out before, during, and/or after the hydrocarbon feed is combined with the aqueous fluid.

The overhead line 1023 can also be isolated from line 1033 by closing valve 1054. The pump 1025 can also be fluidly isolated by closing valves 1028 and 1030. The first end 1040 of the pump-around loop 1024 that is in fluid communication with the vessel 1020 and the second end 1042 of the pump-around loop 1024 that is in fluid communication with the vessel 1020 can be fluidly isolated to provide the fluidly isolated section of the pump-around loop 1024. For example, valves 1044 and 1046 can be closed to fluidly isolate the first end 1040 and the second end 1042 of the pump-around loop 1024, respectively, from the vessel 1020. The first end 1040 of the isolated section of the pump-around loop 1024 can be fluidly connected to the aqueous fluid source by opening valve 1048 and the aqueous fluid in line 1050 can be introduced into the first end 1040 of the isolated section of the pump-around loop 1024. It should be understood that during the online mode the intentional introduction of an oxidant via line 1050 is generally avoided due to the presence of the hydrocarbon feed in line 1015. The second end 1042 of the isolated section of the pump-around loop 1024 can be fluidly connected to line 1033. For example, valve 1052 can be opened and the aqueous fluid introduced to the first end 1040 of the pump-around loop 1024 can flow therethrough and into line 1033 via line 1032.

As the aqueous fluid introduced via line 1050 into the pump-around loop 1024 flows therethrough the aqueous fluid can be heated within line 1029 to produce a heated or second heated mixture. If the aqueous fluid includes liquid water, at least a portion of the liquid water can be heated sufficiently to produce steam. The steam can remove at least a portion of the char deposited within the pump-around loop 1024 via spalling and/or other physical mechanism(s). As such, the second heated mixture introduced from the pump-around loop 1024 into line 1033 via line 1032 can include steam and at least a portion of any char. The first heated mixture in line 1015 and the second heated mixture in line 1032 can be combined to produce a third mixture in line 1033. The third mixture can flow through the heat exchanger or second conduit 1035, through line 1037, and into the radiant tube(s) 1039 disposed within the radiant section 1006 of the seam cracking furnace 1003, and exits the steam cracking furnace via line 1041.

As the third mixture flows through line 1035, line 1037, the radiant tube(s) 1039, line 1041, and optional downstream conduit(s), at least a portion of any coke, asphaltenes, and/or char disposed on the inner surfaces thereof can be removed via spalling and/or other physical mechanism(s). In some embodiments, as the third mixture flows through the radiant tube(s) 1039, at least a portion of the hydrocarbon feed in the first heated mixture from line 1015 can be cracked under steam cracking conditions to produce a steam cracked hydrocarbons. As such, the effluent existing the steam cracking furnace 1003 via line 1041 from the steam cracking furnace 1003 can include hydrogen, steam cracked hydrocarbons such as desirable olefins, naphthas, gas oil, steam cracker tar, uncracked hydrocarbon feed, coke, asphaltenes, steam, char, or any mixture thereof. In some embodiments, the effluent in line 1041 can include one or more olefins, steam, and at least one of char, asphaltenes, and coke. In other embodiments, as the third mixture flows through the radiant tube(s) 1039, the third mixture can be free of the hydrocarbon feed. Said another way, during the online mode, the third mixture may or may not include the hydrocarbon feed.

The online mode can also include purging at least a portion of any liquid phase effluent present in the vessel 1020. For example, with valve 1028 closed to isolate the pump 1025 from the vessel 1020, at least a portion of any liquid phase effluent present within the vessel 1020 can be removed via lines 1021 and 1022 by opening valve 1059 while the section of the pump-around loop 1024 is fluidly isolated from the vessel 1020. In some embodiments, the liquid phase effluent removed via lines 1021 and 1022 can include, in addition to melted/solubilized plastic and, optionally, other hydrocarbons, and/or char. As such, char can also be removed from the system 1000 via lines 1021 and 1022 during the online mode.

Once the online mode has been carried out for a sufficient duration, introduction of the aqueous fluid via line 1050 into the pump-around loop 1024 can be stopped by closing valve 1048. The pump-around loop 1024 can be fluidly reconnected to the vessel 1020 by opening valves 1028, 1030, 1044, and 1046 and closing valves 1052 and 1059. Introduction of the heavy feed via line 1001 can be restarted, e.g., by opening valve 1002. Once a sufficient amount of heavy feed from line 1001 has been introduced into the vessel 1020 the overhead line 1023 can be reconnected to line 1033 by opening valve 1054.

FIG. 2

FIG. 2 depicts another illustrative process/system 2000 for removing char from the pump-around loop 1024 integrated with the plastic pyrolysis vessel 1020 and the steam cracking furnace 1003 and for removing coke deposited within the radiant section 1006 of the steam cracking furnace 1003, in which the char removed from the pump-around loop 1024 is introduced into the plastic pyrolysis vessel 1020, according to one or more embodiments. During normal pyrolysis operation, the process/system 2000 can be configured for steam cracking the mixture in line 1037 that includes the hydrocarbon feed/steam mixture from line 1015 and the vapor phase effluent from line 1023. When a sufficient amount of char has built up in the pump-around loop 1024 and/or a sufficient amount of coke, asphaltenes, and/or char has built up in line 1035, line 1037, the radiant tube(s) 1039, line 1041, and optional downstream conduit(s), the process for removing coke, asphaltenes, and/or char can be initiated and carried out in an offline mode.

Prior to initiating the decharring/decoking operation, introduction of the heavy feed via line 1001 into the vessel 1020 and introduction of the hydrocarbon feed via line 1007 into the convection section 1005 of the steam cracking furnace can be stopped by closing valves 1002 and 1004, respectively. The pump 1025 can also be fluidly isolated from the vessel 1020 and the pump-around loop 1024 by closing valves 1028 and 1030. At least a portion of the contents disposed within the vessel 1020 can be purged therefrom. The contents disposed within the vessel 1020 can be or can include, but is not limited to, melted and/or solubilized plastic material, pyrolyzed plastic material, liquid hydrocarbons such as an optional carrier liquid, char, or any mixture thereof. In one embodiment, valve 1059 can be opened and the contents from the vessel 1020 can flow via line 1021 into purge line 1022 and be removed from the process/system 2000, as described above with reference to FIG. 1. In another embodiment, valve 2018 can be opened and the contents from the vessel 1020 can flow via line 1021 into purge line 2022. If purge line 1022 is used to remove the contents of the vessel 1020, valve 1059 can be closed once the vessel 1020 has been purged to fluidly isolate the purge line 1022 from line 1021. The vessel 1020 can also be fluidly isolated from the first end 1040 of the pump-around loop 1024 by closing valve 1044. If purge line 2022 is used to remove the contents of the vessel 1020, valve 2018 can remain open to allow for a solid-containing bottoms materials to exit vessel 1020 during the decharring operation.

With the first end 1040 of the pump-around loop 1024 fluidly isolated from the vessel 1020 and the pump 1025 fluidly isolated from the pump-around loop 1024, an aqueous fluid and/or oxidant via line 1050 can be introduced into line 1021 by opening valve 1048. The aqueous fluid and/or oxidant can flow via line 2010 bypassing pump 1025. For example, a valve 2012 can be opened to allow the aqueous fluid and/or oxidant to flow therethrough and into line 1027 of the pump-around loop 1024.

As the aqueous fluid and/or oxidant introduced via line 1050 into the pump-around loop 1024 flows therethrough the aqueous fluid and/or oxidant can be heated within line 1029 to produce a heated or first heated mixture. As noted above, in some embodiments, line 1029 can be disposed within a heat exchanger that is external to the convection section 1005 of the steam cracking furnace 1003. The aqueous fluid and/or oxidant can remove at least a portion of the char deposited within the pump-around loop 1024 via spalling and/or other physical mechanism(s). When the oxidant is present at least a portion of the char can be combusted to produce a combustion product. As such, the first heated mixture in line 1031 can include steam, if the oxidant is present, any unreacted oxidant, and at least one of (i) at least a portion of any char, and, if the oxidant is present, (ii) the combustion product. The first heated mixture in line 1031 can flow into the vessel 1020.

A vapor phase overhead via line 1023 and a solid-containing material via line 1021 can be obtained from the vessel 1020. The vapor phase overhead can be in the gas phase or can primarily be in the gas phase with a minor amount in the liquid phase. When a minor amount of the vapor phase overhead in line 1023 is in the liquid phase, such minor amount can be up to about 5 wt %, 4 wt %, 3 wt %, 2 wt %, 1 wt %, 0.5 wt %, 0.1 wt %, or 0.01 wt %, based on the total weight of the vapor phase overhead. The vapor phase overhead in line 1023 can primarily include steam and, if present, oxidant and the combustion product and potentially minor amounts of entrained char and/or hydrocarbons that may be present in the pump-around loop 1024. The solid-containing material in line 1021 can include char. The solid-containing bottoms material in line 1021 can also include liquid, e.g., residual hydrocarbons and/or plastic material. The solid-containing bottoms material in line 1021 can be removed via line 2022 by opening, if not already open, valve 2018. In some embodiments, line 2022 can be close coupled to the vessel 1020 to reduce the likelihood of line 1021 becoming plugged with the char.

With valve 1004 closed such that the hydrocarbon feed in line 1007 is no longer introduced into the process/system 2000, the offline mode can also include introducing an oxidant via line 1056, e.g., by opening valve 1058, and introduction of the aqueous fluid via line 1011 can be continued such that a heated oxidant and steam mixture can be provided in line 1015 that can be combined with the vapor phase overhead in line 1023 to produce a combined mixture in line 1033. The combined mixture in line 1033 can be heated in line 1035 disposed within the convection section 1005 of the steam cracking furnace 1003 and then introduced via line 1037 into the radiant tube(s) 1039 disposed within the radiant section 1006 of the steam cracking furnace 1003.

As the combined mixture in line 1033 flows through line 1035, line 1037, the radiant tube(s) 1039, line 1041, and optional downstream conduit(s), at least a portion of any coke, asphaltenes, and/or char deposited therein can be removed via spalling and/or other physical mechanism(s). At least a portion of any coke, asphaltenes, and/or char deposited within line 1035, line 1037, the radiant tube(s) 1039, line 1041, and optional downstream conduit(s) can also be combusted to produce a combustion product. The combustion product can be produced by combusting at least a portion of any entrained char present in the vapor phase overhead and/or at least a portion of any coke, asphaltenes, and/or char disposed on the inner surfaces of line 1035, line 1037, the radiant tube(s) 1039, line 1041, and/or optional downstream conduit(s).

In some embodiments, introduction of the oxidant via line 1056 can be avoided and introduction of the steam via line 1011 can be stopped such that only the vapor phase overhead in line 1023 flows through line 1033, the heat exchanger 1035, line 1037, into the radiant tube(s) 1039, and line 1041. In such embodiment, the level or degree of fouling within the pump-around loop 1024 and/or the plastic pyrolysis vessel 1020 can be sufficient to require removing at least a portion of the char from the pump-around loop 1024 and/or the plastic pyrolysis vessel 1020, whereas the level or degree of fouling within line 1035, line 1037, the radiant tube(s) 1039, line 1041, and/or optional downstream conduit(s) did not warrant initiating a process to remove coke, asphaltenes, and/or char therefrom. In such embodiment, however, it should be understood that at least some removal of coke, asphaltenes, and/or char from line 1035, line 1037, the radiant tube(s) 1039, line 1041, and/or optional downstream conduit(s) can occur as the vapor phase overhead flows therethrough. In other embodiments, introduction of the oxidant via line 1056 can be avoided and introduction of the steam via line 1011 can be continued such that a combined mixture of the vapor phase overhead in line 1023 and steam in line 1015 flows through line 1033, line 1035, line 1037, the radiant tube(s) 1039, line 1041, and optional downstream conduit(s).

Once the offline mode of removing char from the pump-around loop 1024 and of removing coke, asphaltenes, and/or char from line 1035, line 1037, the radiant tube(s) 1039, line 1041, and/or optional downstream conduit(s) has been carried out for a sufficient duration, introduction of the aqueous fluid and/or oxidant via line 1050 into the pump-around loop 1024 and, if used, introduction of the oxidant via line 1056 into line 1007 can be stopped by closing valves 1048 and 1058, respectively. The pump-around loop 1024 can be fluidly reconnected to the vessel 1020 by opening valves 1028, 1030, and 1044 and closing valves 2018 and 2012. Introduction of the heavy feed via line 1001 and the hydrocarbon feed via line 1007 can be restarted by opening valves 1002 and 1004, respectively.

FIG. 3

FIG. 3 depicts an illustrative process/system 3000 for removing char from the pump-around loop 1024 integrated with the plastic pyrolysis vessel 1020 and the steam cracking furnace 1003 while maintaining steam cracking of the hydrocarbon feed within the radiant section 1006 of the steam cracking furnace 1003, according to one or more embodiments. During normal pyrolysis operation the process/system 3000 can be configured for steam cracking the mixture in line 1037 that includes the hydrocarbon feed/steam mixture from line 1015 and the vapor phase effluent from line 1023. When a sufficient amount of char has built up in the pump-around loop 1024, the process for removing char can be initiated and carried out in an online mode.

The process/system 3000 is similar to the process/system 2000 described above with reference to FIG. 2. The main difference is that only an aqueous fluid via line 1050 is introduced into the pump-around loop 1024 to carry out the decharring operation of the pump-around loop 1024 while the hydrocarbon feed via line 1007 continues to be introduced and combined with the aqueous fluid in line 1011 to produce the first heated mixture in line 1015. As such, steam cracking of the hydrocarbon feed in line 1007 can continue simultaneously with the decharring of the pump-around loop 1024.

The decharring of the pump-around loop 1024 can be initiated in a similar manner as described above with reference to FIG. 2. Prior to initiating the decharring operation, introduction of the heavy feed via line 1001 into the vessel 1020 can be stopped by closing valve 1002. Introduction of the hydrocarbon feed via line 1007 into the convection section 1005 of the steam cracking furnace can be maintained. The pump 1025 can be fluidly isolated from the vessel 1020 and the pump-around loop 1024 by closing valves 1028 and 1030. At least a portion of the contents disposed within the vessel 1020 can be purged therefrom. The contents disposed within the vessel 1020 can be or can include, but is not limited to, melted/solubilized plastic material, pyrolyzed plastic material, liquid hydrocarbons such as an optional carrier liquid, char, or any mixture thereof. In one embodiment, valve 1059 can be opened and the contents from the vessel 1020 can flow via line 1021 into purge line 1022 and be removed from the process/system 2000, as described above with reference to FIG. 1. In another embodiment, valve 2018 can be opened and the contents from the vessel 1020 can flow via line 1021 into purge line 2022. If purge line 1022 is used to remove the contents of the vessel 1020, valve 1059 can be closed once the vessel 1020 has been purged to fluidly isolate the purge line 1022 from line 1021. The vessel 1020 can also be fluidly isolated from the first end 1040 of the pump-around loop 1024 by closing valve 1044. If purge line 2022 is used to remove the contents of the vessel 1020, valve 2018 can remain open to allow for a solid-containing bottoms material to exit vessel 1020 during the decharring operation.

In some embodiments, during stopping introduction of the heavy feed in line 1001 and purging of the vessel 1020, the overhead line 1023 can be fluidly isolated from line 1015 by closing valve 1054. Closing valve 1054 can prevent the heated mixture of the hydrocarbon feed and steam in line 1015 from flowing into the vessel 1020 via the overhead line 1023. With the first end 1040 of the pump-around loop 1024 fluidly isolated from the vessel 1020 and the pump 1025 fluidly isolated from the pump-around loop 1024, an aqueous fluid via line 1050 can be introduced into line 1021 by opening valve 1048. The aqueous fluid can flow around the pump 1025 via the bypass line 2010. For example, valve 2012 can be opened to allow the aqueous fluid and/or oxidant to flow therethrough and into line 1027 of the pump-around loop 1024. If valve 1054 is closed, valve 1054 can be opened once a sufficient amount of the aqueous fluid has been introduced via line 1050 into the pump-around loop 1024.

As the aqueous fluid introduced via line 1050 into the pump-around loop 1024 flows therethrough the aqueous fluid can be heated in line 1029 to produce a heated mixture in line 1031 that can include steam and char that was disposed within the pump-around loop 1024. The aqueous fluid can remove at least a portion of the char deposited within the pump-around loop 1024 via spalling and/or other physical mechanism(s). The first heated mixture in line 1031 can flow into the vessel 1020.

A vapor phase overhead via line 1023 and a solid-containing bottoms material via line 1021 can be obtained from the vessel 1020. The vapor phase overhead can be in the gas phase or can primarily be in the gas phase with a minor amount in the liquid phase. When a minor amount of the vapor phase overhead in line 1023 is in the liquid phase, such minor amount can be up to about 5 wt %, 4 wt %, 3 wt %, 2 wt %, 1 wt %, 0.5 wt %, 0.1 wt %, or 0.01 wt %, based on the total weight of the vapor phase overhead. The vapor phase overhead in line 1023 can primarily include steam and potentially minor amounts of entrained char and/or hydrocarbons that may be present in the pump-around loop 1024. The solid-containing bottoms material in line 1021 can include char. The solid-containing bottoms material in line 1021 can also include liquid, e.g., residual hydrocarbons, plastic material, condensed steam, or a mixture thereof. The solid-containing bottoms material in line 1021 can be removed via line 2022 by opening, if not already open, valve 2018. In some embodiments, line 2022 can be close coupled to the vessel 1020 to reduce the likelihood of line 1021 becoming plugged with the char.

The heated mixture of hydrocarbon feed and steam in line 1015 can be combined with the vapor phase overhead in line 1023 (with valve 1054 open) to produce a combined mixture in line 1033. The combined mixture in line 1033 can be heated in line 1035 disposed within the convection section 1005 of the steam cracking furnace 1003 and then introduced via line 1037 into the radiant tube(s) 1039 disposed within the radiant section 1006 of the steam cracking furnace 1003. As the combined mixture in line 1033 flows through line 1035, line 1037, the radiant tube(s) 1039, line 1041, and optional downstream conduit(s), at least a portion of any coke, asphaltenes, and/or char deposited therein can be removed via spalling and/or other physical mechanism(s) and exit the steam cracking furnace 1003. As such, the effluent in line 1041 can include cracked hydrocarbon, e.g., ethylene, propylene, and/or butene, uncracked hydrocarbon feed, coke, asphaltenes, steam, and/or char.

The effluent exiting via line 1041 from the stream cracking furnace 1003 can be introduced into a heat exchanger 3002 to produce a cooled effluent via line 3041. In some embodiments, a quench fluid via line 3004 can be introduced into the heat exchanger 3002 and contacted with the effluent to produce the cooled effluent in line 3041. In other embodiments, a heat transfer fluid can be introduced into the heat exchanger 3002 and heat can be indirectly transferred from the effluent to the heat transfer fluid to produce the cooled effluent in line 1041 and heated heat transfer fluid. In still other embodiments, both direct contact with the quench fluid in line 3004 and indirect heat exchange with a heat transfer fluid can be used to produce the cooled effluent via line 3041. It should be understood that the heat exchanger 3002 can be present in the embodiments described above with reference to FIGS. 1 and 2.

In some embodiments, the solid-containing bottoms material in line 2022 can be combined with the effluent in line 1041 via line 3008 to produce a combined mixture in line 1041. In other embodiments, the solid-containing bottoms material in line 2022 can be combined with the cooled effluent in line 3041 via line 3010 to produce a combined mixture in line 3041. In still other embodiments, a first portion of the solid-containing bottoms material in line 2022 can be combined with the effluent in line 1041 via line 3008 and a second portion of the solid-containing bottoms material in line 2022 can be combined with the cooled effluent in line 3041 via line 3010. In still other embodiments, the solid-containing bottoms material can be directed to a processing unit configured to process the solid-containing bottoms material without combining the solid-containing bottoms material with the effluent in line 1041 or the cooled effluent in line 3041.

Once the online mode removal of char from the pump-around loop 1024 illustrated in FIG. 3 has been carried out for a sufficient duration, introduction of the aqueous fluid via line 1050 into the pump-around loop 1024 can be stopped by closing valve 1048. The pump-around loop 1024 can be fluidly reconnected to the vessel 1020 by opening valves 1028, 1030, and 1044 and closing valves 2018 and 2012. Introduction of the heavy feed via line 1001 can be restarted by opening valve 1002. In some embodiments, valve 1054 can be closed during the transition from the online mode decharring operation back to normal operation until a sufficient amount of heavy hydrocarbon feed via line 1001 has been introduced into the vessel 1020.

In an alternative embodiment, line 1029, in any one of the processes/systems 1000, 2000, and 3000 described above with reference to FIGS. 1-3, can be disposed within an external heat exchanger, i.e., not located within the convection section 1005 of the steam cracking furnace 1003, either during normal pyrolysis operation or during the removal of char from the pump-around loop and/or the removal of coke, asphaltenes, and/or char from line 1035, line 1037, the radiant tube(s) 1039, line 1041, and/or optional downstream conduit(s). In one such alternative embodiment, a heated fluid medium can be introduced into the external heat exchanger and heat can be indirectly transferred from the heated fluid medium to the fluid in line 1027 into the external heat exchanger. A cooled fluid medium and the heated mixture via line 1031 can be obtained from the external heat exchanger. In some embodiments, the heated fluid medium that can be introduced into the external heat exchanger can be or can include, but is not limited to, one or more heated hydrocarbons, steam, a heated combustion or flue gas, a non-hydrocarbon fluid, e.g., liquid phase water, any combination thereof, or any mixture thereof. It should be understood that multiple heat exchangers external to the convection section 1005 can be used and the heated fluid mediums can have the same composition or different compositions as well as the same or different temperatures with respect to one another. In another such alternative embodiment, one or more electrical heating elements can be used to provide the heat to the external heat exchanger 1029. For example, a radiant/conductive heat source can be disposed within the external heat exchanger that can be or can include one or more electric heating elements that can heat the aqueous fluid and/or oxidant introduced via line 1027 into the external heat exchanger. In still other embodiments, a heated fluid medium and one or more electrical heating elements can be used to heat the aqueous fluid and/or oxidant introduced via line 1027 into the external heat exchanger.

Plastic Pyrolysis Conditions

In some embodiments, the plastic material in the heavy feed in line 1001 can have been treated to remove at least a portion of any contaminants therefrom. In other embodiments, the plastic material in the heavy feed in line 1001 can be used as received. If the plastic material is treated to remove at least a portion of any contaminants therefrom, such treatment can include, but is not limited to, sortation, filtration, water washing, solvent extraction, contact with super-critical water, contact with supercritical carbon dioxide, or any combination thereof. In some embodiments, the plastic material in the heavy feed in line 1001 can have been subjected to one or more physical processes such as chopping, grinding, shredding, or other suitable process that can reduce the size of the plastic material. In some embodiments, the plastic material can have a median particle size of 10 cm or less, 3 cm or less, 2.5 cm or less, 2 cm or less, 1 cm or less, 0.1 cm or less, or 0.01 cm or less. The median particle size is the diameter of the smallest bounding sphere that contains the plastic particle.

The heavy feed in line 1001, treated and/or subjected to one or more physical processes or as received, can be introduced into a vessel 1020. In some embodiments, the process/system 1000 can include two or more vessels 1020 with each vessel 1020 configured to receive a portion of the heavy feed in line 1001 and/or separate heavy feeds having the same or different compositions with respect to one another. In some embodiments, the heavy feed in line 1001 can be introduced into the vessel 1020 at ambient temperature. In other embodiments, the heavy feed in line 1001 can be pre-heated to a temperature in a range, e.g., from 50° C., 75° C., 100° C., or 150° C. to 200° C., 275° C., or 350° C. At least a portion of the plastic material in the heavy feed introduced via line 1001 into the vessel 1020 can be cracked in the vessel 1020 under plastic pyrolysis conditions to produce the vapor phase effluent and a liquid phase effluent that can be recovered or otherwise obtained via lines 1023 and 1021, respectively, from the vessel 1020.

In some embodiments, the plastic pyrolysis conditions in the vessel 1020 can include an average temperature in the vessel 1020 in a range, e.g., from 275° C., 300° C., 325° C., 350° C., or 375° C. to 400° C., 425° C., 450° C., 475° C., 500° C., 525° C., or 550° C. Under such temperature, the plastic material and some heavy hydrocarbons undergo thermal pyrolysis to produce smaller, lighter molecules, e.g., molecular hydrogen, C1-C4 hydrocarbons, and C5+ hydrocarbons, in the vessel 1020. Thus, the vessel 1020 serves in part as a thermal pyrolysis reactor. The thermal pyrolysis reactions can be generally endothermic. In some embodiments, such desirable temperature in the vessel 1020 can be partly achieved and maintained by including an internal heater (e.g., a heat exchanger) in the vessel 1020, in addition to heating via exchanger 1029 of the recycle fluid stream 1027 and/or pre-heating of stream 1001. In a preferred embodiment, however, no internal heater is installed within vessel 1020 to reduce fouling and simplify necessary cleaning inside vessel 1020, and the temperature in vessel 1020 is achieved and/or maintained by the suitable temperature and flow rate of streams in lines 1001 and 1031 as described below. In preferred embodiments, the heavy feed stream in line 1001 has a temperature lower (e.g., 100° C., 120° C., 140° C., 150° C., 160° C., 180° C., 200° C., 220° C., 240° C., 250° C., 260° C., 280° C., 300° C. lower) than that of the fluid stream in line 1031. Inside vessel 1020, fluids from lines 1001 and 1031 can be mixed (e.g., by one or more agitating means such as a rotating mixer inside the vessel 1020, not shown) to achieve the desired average temperature inside the vessel. In some embodiments, the plastic pyrolysis conditions in the vessel 1020 can include a pressure in the vessel in a range, e.g., from 350 kPa-gauge, 500 kPa-gauge, 700 kPa-gauge, or 1,000 kPa-gauge to 1,250 kPa-gauge, 1,500 kPa-gauge, or 1,750 kPa-gauge. In some embodiments, the plastic pyrolysis conditions in the vessel 1020 can include a residence time in the vessel 1020 sufficient to crack at least a portion of the plastic material. Depending, at least in part, on the composition and amount of the plastic material in the heavy feed introduced via in line 1001 into the vessel 1020, the temperature within the vessel 1020 and/or the amount of time required to crack a desired amount of the plastic material can widely vary. Typically, increasing the temperature can reduce the amount of time required for a given quantity of a given plastic material to be cracked under the plastic pyrolysis conditions to produce the vapor phase effluent and the liquid phase effluent.

During pyrolysis operation in the processes/systems illustrated in FIGS. 1-3, by pumping the plastic-containing liquid stream 1027 and heating the same in the heat exchanger 1029 in the convection section 1003, unreacted plastic material and heavy molecules (such as heavy hydrocarbons) contained therein can be exposed to pyrolysis conditions in vessel 1020 a second, or even multiple times, effectively extending the residence time thereof to achieve the desired level of pyrolysis under the desired pyrolysis conditions such as a temperature without causing excessive coking in vessel 1020 and connected pump and conduit lines. The thermal energy entrained in the flue gas exiting the radiant section 1006 of the steam cracking furnace can be effectively and efficiently used to heat the fluid stream in exchanger 1029. Hydrocarbons such as $C_1$-$C_4$ gases and those boiling in naphtha boiling ranges exiting vessel 1020 in the vapor phase effluent 1023, which are highly suitable for steam cracking, can be combined with the heated mixture in line 1015 that includes hydrocarbons and steam, further heated, and then cracked in the radiant section 1006 of the steam cracking furnace 1003.

In some embodiments, a liquid medium, e.g., a carrier liquid, can be mixed, blended, combined, or otherwise contacted with the liquid phase effluent in the pump-around loop 1024. In some embodiments, when the heavy feed in line 1001 includes a majority or only one or more plastic materials, contacting the liquid phase effluent in the pump-around loop 1024 with the liquid medium can help facilitate the flow of the liquid phase effluent within the pump-around loop 1024 by forming a mixture having a reduced viscosity or otherwise improving flow through dilution as compared to the liquid phase effluent before combining with the liquid medium. In other embodiments, at least a portion of the liquid medium can be combined with and be a part of the heavy hydrocarbon feed in line 1001 and/or combined within the vessel 1020. In some embodiments, the flow rate of the heavy feed in line 1001 and, when used, the flow rate of the liquid medium can be controlled through level control on the vessel 1020 and through the flow rate of the purge stream removed via line 1022 from the process/system 1000.

Steam Cracking Conditions

The steam cracking conditions within the radiant section 1006 of the steam cracking furnace 1003 can include, but are not limited to, one or more of: exposing the heated combined mixture to a temperature (as measured at a radiant outlet of the steam cracker) of ≥400° C., e.g., a temperature of about 700° C., about 800° C., or about 900° C. to about 950° C., about 1,000° C., or about 1050° C., a pressure of about 100 kPa-absolute to about 600 kPa-absolute, and/or a steam cracking residence time of about 0.01 seconds to about 5 seconds. In some embodiments, the heated combined mixture can be steam cracked according to the processes and systems disclosed in U.S. Pat. Nos. 6,419,885; 7,993,435; 9,637,694; and 9,777,227; U.S. Patent Application Publication No. 2018/0170832; and International Patent Application Publication No. WO 2018/111574. The steam cracker effluent in line 1041, at an outlet of the radiant tube(s) 1039, can be at a temperature of ≥400° C., e.g., a temperature of about 700° C., about 800° C., or about 900° C. to about 950° C., about 1,000° C., or about 1050° C. It should also be understood that the steam cracking furnace 1003 may be operated to combust any fuel suitable for a steam cracking furnace to generate the thermal energy required for the pyrolysis of hydrocarbon molecules in the radiant section of the furnace. Such fuel can include, e.g., methane, natural gas, hydrogen, and mixtures thereof at any proportion.

In some embodiments, the steam cracking furnace 1003 can include a plurality of internal heat exchangers 1035 and a plurality of radiant tubes 1039. Each internal heat exchanger 1035 can be in fluid communication with a corresponding radiant tube 1039 or two or more corresponding radiant tubes 1039 such that a plurality of separate "passes" through the convection section 1035 and the radiant section 1006 can be present within the steam cracking furnace 1003. One or more of the "passes" through the convection section 1035 can be configured to receive the combined mixture in line 1033 such that only some of the "passes" process the combined mixture in line 1033. Each individual "pass" through the convection section 1005 and the radiant section 1006 can be configured to process a unique feed that can be controlled independently from one another. As such, in some embodiments, the steam cracking furnace 1003 can process the combined mixture in line 1033 that includes one or more hydrocarbons produced by pyrolyzing the plastic material within the vessel 1020 in one or more "passes" while simultaneously processing one or more additional hydrocarbon feeds that do not contain the one or more hydrocarbons produced by pyrolyzing the plastic material within the vessel 1020 in one or more other "passes". For example, in some embodiments, a first portion of the heated mixture in line 1015 can be combined with the vapor phase effluent in line 1023 and a second portion of the heated mixture in line 1015 can be routed through another heat exchanger disposed within the convection section 1005 of the steam cracking furnace 1003 and then into one or more separate radiant tubes 1039 disposed within the radiant section 1006 of the steam cracking furnace 1003. In other examples, multiple hydrocarbon feeds having the same or different compositions can be heated with one or more hydrocarbon feeds being combined with the vapor phase effluent in line 1023 and one or more hydrocarbon feeds being processed separately, i.e., not combined with the vapor phase effluent in line 1023, within the radiant section 1006 of the steam cracking furnace 1003. The process conditions, e.g., flow rate, temperature, and/or pressure, within each of the one or more "passes" can be the same or different with respect to one another.

In some embodiments, the heated mixture in line 1037 can be a gas/liquid phase mixture. In such embodiment, the processes/systems 1000, 2000, and 3000 can be configured to obtain a vapor phase overhead and a liquid phase bottoms by introducing the mixture in line 1037 into a separation drum. The vapor phase overhead can be heated (e.g., in the convection section 1005 of the steam cracking furnace 1003) and then introduced into the radiant tube(s) 1039 disposed within the radiant section of the steam cracking furnace 1003. The separation drum can also be referred to as a vapor-liquid separator, vaporization drum, or flash drum. In some embodiments, the liquid phase bottoms recovered from the separation drum can have a cutoff point of from 300° C. to 700° C., e.g., 310° C. to 550° C., as measured according to ASTM D1160-18, ASTM D-86-20b, or ASTM D2887-19ae2. Conventional separation drums can be utilized to do this, though the invention is not limited thereto. Examples of such conventional separation drums can include those disclosed in U.S. Pat. Nos. 7,097,758; 7,138,047; 7,220,887; 7,235,705; 7,244,871; 7,247,765; 7,297,833; 7,311,746; 7,312,371; 7,351,872; 7,427,381; 7,488,459; 7,578,929; 7,674,366; 7,767,008; 7,820,035; 7,993,435; 8,105,479; and 9,777,227.

In some embodiments, at least portion of the liquid phase bottoms recovered from the separation drum can be recycled to the vessel 1020 and further subjected to the plastic pyrolysis conditions therein. In other embodiments, at least a portion of the liquid phase bottoms recovered from the separation drum can be recycled to the hydrocarbon feed in line 1007 such that the liquid phase bottoms can make up at least a portion of the hydrocarbon feed in line 1007. In other embodiments, at least a portion of the liquid phase bottoms recovered from the separation drum can be used as a carrier liquid that can be present in the heavy feed in line 1001 and/or added to the vessel 1020, and/or combined with the liquid bottoms within the pump-around loop 1024 recovered from the vessel 1020. In other embodiments, at least a portion of the liquid phase bottoms recovered from the separation drum can be removed from the processes/systems 1000, 2000, and 3000 and further processed in one or more other refinery, chemical, or other petrochemical operations and/or separated out into two or more products.

It should be understood that the steam cracking furnace 1003 can be operated on all hydrocarbon feeds that can be processed in a steam cracking furnace. For example, the hydrocarbon feed can be operated exclusively on one or more hydrocarbons that are gaseous at room temperature, e.g., ethane, propane, and/or butane, one or more hydrocarbons that are liquid at room temperature, e.g., naphtha, one or more hydrocarbons that are solid at room temperature, e.g., heavy fractions obtained from a crude oil, or any combination or mixture thereof.

In some embodiments, during the start-up of the process/systems 1000, 2000, and 3000 (whether the first time or after a shutdown), heat can be transferred into the vessel 1020 via a heat exchanger, e.g., a steam jacket or internal heating tubes configured to carry steam or other heated medium therethrough, heating elements, a flue gas recovered from the steam cracking furnace 1003, and/or any other suitable heat source. In other embodiments, during the start-up of the process/system 1000, the heavy feed in line 1001 can have a sufficiently low viscosity or otherwise improved flow characteristics that the heavy feed can be obtained via line 1021, transferred via line 1027 into and through the heat exchanger 1029 for heating, and then reintroduced via line 1031 into the vessel 1020. In still other embodiments, during the start-up of the process/system 1000, the heavy feed in line 1001 can be first heated within the convection section 1005 to produce a heated heavy feed that can be introduced into the vessel 1020. In still other embodiments, during the start-up of the process/system 1000, a carrier liquid can be heated within the convection section 1005, e.g., within heat exchanger 1029 and introduced into the vessel 1020, and the heavy hydrocarbon feed that can be or can include the plastic material can be added after one or more process conditions within the vessel 1020, e.g., a temperature with the vessel 1020, have reached a predetermined value(s).

In the embodiments shown in FIGS. 1-3, the vessel 1020 is shown to be connected with a single steam cracking furnace. It is further contemplated that, in certain preferred embodiments, the vessel 1020 may be connected with multiple steam cracking furnaces. For example, in one embodiment (not shown), a split stream of the liquid stream in line 1021 may be pumped and sent to a heat exchanger located in the convection section of a second steam cracker (not shown), where it is heated, and then returned into vessel 1020 after optionally being combined with the heated fluid stream in line 1031, or at a differing location on vessel 1020 than the entry point of line 1031. In another embodiment (not shown), a split stream of the vapor phase effluent in line 1023 may be fed into a second steam cracking furnace, optionally after being mixed with another hydrocarbon/steam stream, heated in the convection section of the second streaking furnace, and then fed into the radiant section of the second cracking furnace. Thus, the vessel 1020 can be configured to work simultaneously or alternately with two or more steam cracking furnaces. Such multiple steam cracking furnace arrangement can ensure continued plastic pyrolysis and steam cracking operation even if one steam cracking furnace stopped operation due to, e.g., decoking, maintenance, or other needs.

In the embodiments shown in FIGS. 1-3, a single vessel 1020 is shown to be connected with a single steam cracking furnace. It is further contemplated that, in certain preferred embodiments, multiple vessels 1020, of the same, similar, of differing sizes and/or designs, may be connected with one or multiple steam cracking furnaces. For example, in one embodiment (not shown), one vessel 1020 can be designed and configured to accept a first type of heavy feed comprising a first plastic material, and a second vessel 1020 can be designed to accept a second type of heavy feed comprising a second plastic material which may be the same or different from the first plastic material. Where the first and second plastic materials differ, the two vessels 1020 can be operated under differing pyrolysis conditions to suit the needs of the differing plastic materials. The vapor effluent streams in lines 1023 exiting the two vessels 1020 can be combined and then fed into a steam cracking furnace optionally together with a hydrocarbon stream. The liquid effluent streams 1021 exiting the two vessels 1020, if differing substantially in terms of temperature and/or composition, may be separately pumped into separate heat exchangers in the convection section(s) of one or more steam cracking furnaces, and then returned to the same or different vessel 1020. Such embodiments including multiple vessels 1020 can have the advantage of being capable of handling multiple differing plastic materials requiring differing pyrolysis conditions.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for removing deposits formed in a pyrolysis process using a pump-around loop, wherein the pump-around loop is in fluid communication with a vessel for cracking plastic, comprising:

fluidly isolating a first end of the pump-around loop that is in fluid communication with the vessel and a second end of the pump-around loop that is in fluid communication with the vessel to provide a fluidly isolated section of the pump-around loop, wherein the fluidly isolated section comprises a first conduit disposed within a convection section of a steam cracking furnace or a heat exchanger that is external to the steam cracking furnace, and wherein the fluidly isolated section of the pump-around loop comprises char deposited on an inner surface of the first conduit;

fluidly connecting the first end of the isolated section of the pump-around loop to an aqueous fluid and oxidant source;

fluidly connecting the second end of the isolated section of the pump-around loop with a second conduit disposed within the convection section of the steam cracking furnace;

introducing an aqueous fluid and an oxidant from the aqueous fluid and oxidant source into the first end of the isolated section of the pump-around loop;

heating the aqueous fluid and oxidant by flowing the aqueous fluid and oxidant through the fluidly isolated section of the pump-around loop to produce a first heated mixture comprising steam and at least one of char, any unreacted oxidant, and a combustion product produced by combusting at least a portion of the char;

flowing the first heated mixture through the second conduit to produce a second heated mixture; and introducing the second heated mixture into a radiant section of the steam cracking furnace.

2. The process of claim 1, further comprising:

heating an oxidant within the convection section of the steam cracking furnace and combining the oxidant with an aqueous fluid to produce a heated oxidant and steam mixture comprising the oxidant and steam, wherein the heating is carried out before, during, and/or after the oxidant is combined with the aqueous fluid; and combining the heated oxidant and steam mixture with the first heated mixture upstream of the second conduit to produce a combined heated mixture, wherein the combined heated mixture flows through the second conduit to produce the second heated mixture.

3. The process of claim 2, wherein:

the second heated mixture flows through a conduit disposed within the radiant section of the steam cracking furnace that comprises coke disposed on an inner surface thereof, and flowing the second heated mixture through the conduit disposed within the radiant section of the steam cracking furnace produces an effluent comprising at least a portion of the coke, a combustion product produced by combusting at least a portion of the coke, or a mixture thereof.

4. The process of claim 1, wherein a liquid phase effluent comprising melted and/or solubilized plastic, pyrolyzed plastic, or a mixture thereof is disposed within the vessel, the process further comprising purging at least a portion of the liquid phase effluent from the vessel while the first and second ends of the pump-around loop are fluidly isolated from the vessel.

5. The process of claim 1, wherein the first end of the isolated section of the pump-around loop into which the aqueous fluid and the oxidant are introduced is located between the first conduit and a pump or between the pump and the vessel.

6. The process of claim 1, wherein the char deposited on the inner surface of the first conduit is produced by subjecting a heavy feed comprising a plastic material to plastic pyrolysis conditions.

7. The process of claim 6, wherein the plastic material comprises a nitrogen-containing polymer, a chlorine-containing polymer, a bromine-containing polymer, a fluorine-containing polymer, an oxygen-containing polymer, a polyethylene polymer, a polypropylene polymer, a polystyrene polymer, a polyamide polymer, polyethylene terephthalate, ethylene vinyl acetate, a butadiene polymer, an isoprene polymer, an isobutylene polymer, or a mixture thereof.

8. The process of claim 1, wherein the first conduit is disposed within the convection section of the steam cracking furnace.

9. A process for removing deposits formed in a pyrolysis process using a pump-around loop, wherein the pump-around loop is in fluid communication with a vessel for cracking plastic, comprising:

heating a hydrocarbon feed within a convection section of a steam cracking furnace and combining the hydrocarbon feed with an aqueous fluid to produce a first heated mixture comprising hydrocarbons and steam, wherein the heating is carried out before, during, and/or after the hydrocarbon feed is combined with the aqueous fluid;

fluidly isolating a first end of the pump-around loop that is in fluid communication with the vessel and a second end of the pump-around loop that is in fluid communication with the vessel to provide a fluidly isolated section of the pump-around loop, wherein the fluidly isolated section comprises a first conduit disposed within the convection section of the steam cracking furnace or a heat exchanger that is external to the steam cracking furnace, and wherein the fluidly isolated section of the pump-around loop comprises char deposited on an inner surface of the first conduit;

fluidly connecting the first end of the isolated section of the pump-around loop to an aqueous fluid source;

fluidly connecting the second end of the isolated section of the pump-around loop to a second conduit disposed within the convection section of the steam cracking furnace;

introducing an aqueous fluid from the aqueous fluid source into the first end of the isolated section of the pump-around loop;

heating the aqueous fluid by flowing the aqueous fluid through the fluidly isolated section of the pump-around loop to produce a second heated mixture comprising steam and char;

combining the second heated mixture with the first heated mixture to produce a third mixture;

flowing the third mixture through the second conduit to produce a heated third mixture; and introducing the heated third mixture into a radiant section of the steam cracking furnace.

10. The process of claim 9, wherein:

the third heated mixture flows through a conduit disposed within the radiant section of the steam cracking furnace that comprises coke disposed on an inner surface thereof, and flowing the third heated mixture through the conduit disposed within the radiant section of the steam cracking furnace produces an effluent comprising one or more olefins.

11. The process of claim 9, wherein a liquid phase effluent comprising melted and/or solubilized plastic, pyrolyzed plastic, or a mixture thereof is disposed within the vessel, the process further comprising purging at least a portion of the liquid phase effluent from the vessel while the first and second ends of the pump-around loop are fluidly isolated from the vessel.

12. The process of claim 9, wherein:

the char deposited on an inner surface of the first conduit is produced by subjecting a heavy feed comprising a plastic material to plastic pyrolysis conditions, and the hydrocarbon feed comprises crude oil or a fraction thereof.

13. The process of claim 12, wherein the plastic material comprises a nitrogen-containing polymer, a chlorine-containing polymer, an oxygen-containing polymer, a polyethylene polymer, a polypropylene polymer, a polystyrene polymer, a polyamide polymer, polyethylene terephthalate, ethylene vinyl acetate, a butadiene polymer, an isoprene polymer, an isobutylene polymer, or a mixture thereof.

14. The process of claim 9, wherein the first conduit is disposed within the convection section of the steam cracking furnace.

15. A process for removing deposits formed in a pyrolysis process using a pump-around loop, wherein the pump-around loop is in fluid communication with a vessel for cracking plastic, comprising:

fluidly isolating a first end of the pump-around loop that is in fluid communication with the vessel, wherein the pump-around loop comprises a conduit disposed within a convection section of a steam cracking furnace or a heat exchanger that is external to the steam cracking furnace and has a second end in fluid communication with the vessel, and wherein the pump-around loop comprises char deposited on an inner surface of the conduit disposed within the convection section or the heat exchanger;

fluidly connecting the first end of the pump-around loop to an aqueous fluid and/or oxidant source;

introducing an aqueous fluid and/or an oxidant from the aqueous fluid and/or oxidant source into the first end of the pump-around loop;

heating the aqueous fluid and/or oxidant by flowing the aqueous fluid and/or oxidant through the pump-around loop to produce a first heated mixture comprising steam, at least one of char and if the oxidant is present, any unreacted oxidant and a combustion product produced by combusting at least a portion of the char;

introducing the first heated mixture into the vessel;

obtaining a vapor phase overhead and a solid-containing bottoms material from the vessel; and introducing the vapor phase overhead into a radiant section of the steam cracking furnace.

16. The process of claim 15, wherein:

the vapor phase overhead flows through a conduit disposed within the radiant section of the steam cracking furnace that comprises coke disposed on an inner surface thereof, and flowing the vapor phase overhead through the conduit disposed within the radiant section produces an effluent comprising at least one of coke and, if the oxidant is present, any unreacted oxidant and a combustion product produced by combusting at least a portion of the coke disposed on the inner surface of the conduit disposed within the radiant section of the steam cracking furnace.

17. The process of claim 16, further comprising:

heating an oxidant within the convection section of the steam cracking furnace and combining the oxidant with an aqueous fluid to produce a heated oxidant and steam mixture comprising the oxidant and steam, wherein the heating is carried out before, during, and/or after the oxidant is combined with the aqueous fluid; and combining the vapor phase overhead with the heated oxidant and steam mixture to produce a combined mixture, wherein the combined mixture is introduced into the radiant section of the steam cracking furnace, and wherein the effluent comprises the combustion product.

18. The process of claim 15, wherein a liquid phase effluent comprising melted and/or solubilized plastic, pyrolyzed plastic, or a mixture thereof is disposed within the vessel, the process further comprising purging at least a portion of the liquid phase effluent from the vessel after fluidly isolating the first end of the pump-around loop and before fluidly connecting the first end of the pump-around loop to the steam/oxidant source.

19. The process of claim 15, wherein the pump-around loop comprises a pump located between the first and second ends of the pump-around loop, the process further comprising:

fluidly isolating the pump from the pump-around loop; and fluidly connecting a bypass conduit that bypasses the pump, wherein the aqueous fluid and/or the oxidant is introduced into the first end of the pump-around loop upstream of the pump, and wherein the aqueous fluid and/or the oxidant bypasses the pump via the bypass conduit.

20. The process of claim 15, wherein the vessel comprises char disposed therein, and wherein the solid-containing bottoms material obtained from the vessel comprises at least a portion of the char that was disposed within the vessel.

21. A process for removing deposits formed in a pyrolysis process using a pump-around loop, wherein the pump-around loop is in fluid communication with a vessel for cracking plastic, comprising:

heating a hydrocarbon feed within a convection section of a steam cracking furnace and combining the hydrocarbon feed with an aqueous fluid to produce a heated first mixture comprising hydrocarbons and steam, wherein the heating is carried out before, during, and/or after the hydrocarbon feed is combined with the aqueous fluid;

fluidly isolating a first end of the pump-around loop that is in fluid communication the vessel, wherein the pump-around loop comprises a conduit disposed within the convection section of the steam cracking furnace or a heat exchanger that is external to the steam cracking furnace and has a second end in fluid communication with the vessel, and wherein the pump-around loop comprises char deposited on an inner surface of the conduit disposed within the convection section or the heat exchanger;

fluidly connecting the first end of the pump-around loop to an aqueous fluid source;

introducing an aqueous fluid from the aqueous fluid source into the first end of the pump-around loop;

heating the aqueous fluid by flowing the aqueous fluid through the pump-around loop to produce a heated second mixture comprising steam and at least a portion of the char;

introducing the heated second mixture into the vessel;

obtaining a vapor phase overhead and a solid-containing bottoms material from the vessel;

combining the vapor phase overhead with the heated first mixture to produce a third mixture; and introducing the third mixture into a radiant section of the steam cracking furnace.

22. The process of claim 21, wherein:

the third mixture flows through a conduit disposed within the radiant section of the steam cracking furnace, and flowing the third mixture through the conduit disposed within the radiant section of the steam cracking furnace produces an effluent comprising one or more olefins.

23. The process of claim 22, further comprising:

cooling the effluent produced in the radiant section of the steam cracking furnace to produce a cooled effluent; and combining at least a portion of the solid-containing bottoms material with the effluent, the cooled effluent, or a combination thereof.

24. The process of claim 21, wherein a liquid phase effluent comprising melted and/or solubilized plastic, pyrolyzed plastic, or a mixture thereof is disposed within the vessel, the process further comprising purging at least a portion of the liquid phase effluent from the vessel after fluidly isolating the first end of the pump-around loop and before fluidly connecting the first end of the pump-around loop to the steam/oxidant source.

25. The process of claim 21, wherein the pump-around loop comprises a pump located between the first and second ends of the pump-around loop, the process further comprising:

fluidly isolating the pump from the pump-around loop; and fluidly connecting a bypass conduit that bypasses the pump, wherein the steam from the steam source is introduced into the first end of the pump-around loop upstream of the pump, and wherein the aqueous fluid from the aqueous fluid source bypasses the pump via the bypass conduit.

* * * * *